United States Patent [19]

Chasman et al.

[11] 4,139,379

[45] Feb. 13, 1979

[54] PHOTOGRAPHIC ELEMENTS CONTAINING BALLASTED ELECTRON-ACCEPTING NUCLEOPHILIC DISPLACEMENT COMPOUNDS

[75] Inventors: Richard A. Chasman, Hilton; Richard P. Dunlap, Macedon; Jerald C. Hinshaw, Penfield, all of N.Y.

[73] Assignee: Eastman Kodak Company, Rochester, N.Y.

[21] Appl. No.: 775,025

[22] Filed: Mar. 7, 1977

[51] Int. Cl.[2] ..... G03C 7/00; G03C 5/54; G03C 1/40; G03C 1/48

[52] U.S. Cl. ..... 96/3; 96/16; 96/29 D; 96/50 R; 96/51; 96/73; 96/74; 96/76 R; 96/76 C; 96/77; 96/95; 96/99; 96/100 R; 96/109; 96/111

[58] Field of Search ..... 96/3, 29 D, 77, 99, 96/76 R, 119 R, 95, 50 R, 51, 111, 100, 16, 109, 73, 74, 48 R, 76 C

[56] References Cited

U.S. PATENT DOCUMENTS

| | | | |
|---|---|---|---|
| 2,681,364 | 6/1954 | Long et al. | 260/558 |
| 2,846,307 | 8/1958 | Woolley | 96/55 |
| 2,937,204 | 5/1960 | Harris et al. | 260/558 |
| 3,185,567 | 5/1965 | Rogers | 96/3 |
| 3,443,939 | 5/1969 | Bloom et al. | 96/3 |
| 3,443,940 | 5/1969 | Bloom et al. | 96/3 |
| 3,515,790 | 6/1970 | Burdeaka et al. | 424/309 |
| 3,728,113 | 4/1973 | Becker et al. | 96/3 |
| 3,877,941 | 4/1975 | Lohmann | 96/48 R |
| 3,980,479 | 9/1976 | Fields et al. | 96/29 D |

FOREIGN PATENT DOCUMENTS

| | | | |
|---|---|---|---|
| 668505 | 8/1963 | Canada | 96/3 |

OTHER PUBLICATIONS

"A Novel . . . Amino-Protecting Groups", Panetta, *The J. of Organic Chem.* 34, 1969, pp. 2773–2775.

"Electronic . . . Ascorbic Acid", Okano et al., *J. of the Pharmaceutical Soc. of Japan*, vol. 89, No. 1, pp. 67–73, 1969.

"Nitrogen Heterocyclics . . ." Chem. Abstracts, vol. 73, No. 87902z, 1970.

"4–Substituted . . . Piperazines", Chem. Abstracts, vol. 74, No. 31778s, 1971.

"Derivatives . . . Schislosomicides", Chem. Abstracts, No. 76682t, vol. 75, 1971.

*The Biochemical Journal*, vol. 37, 1943, pp. 326–329, Cambridge at the University Press, Great Britain.

"The Removal . . . From Peptides," Holley et al., *JACS* 74, 1952, pp. 3069–3074.

"Methods of Peptide Sequencing. Part II . . . Peptides," Johnstone et al., *J. C. S. Perkin I*, 1975, pp. 1424–1427.

"Kinetics of . . . Aminobenzoates", *J. C. S. Perkin II* 1975, pp. 1512–1515.

"Stereopopulaton Control . . . Displacement", Borchardt et al., *J. of Am. Chem. Soc.* 94:26, 12/1972, pp. 9166–9174.

*Primary Examiner*—Richard L. Schilling
*Attorney, Agent, or Firm*—G. E. Battist

[57] ABSTRACT

Photographic elements, processes for forming images in photographic elements and new compounds are disclosed. Generally, the invention relates to ballasted electron-accepting nucleophilic displacement compounds; after acceptance of at least one electron (reduction) by a nucleophile precursor group, the compounds are capable of undergoing intramolecular nucleophilic displacement to release a diffusible moiety, such as an image dye or a photographic reagent. In certain embodiments, the ballasted electron-accepting nucleophilic displacement compounds are used in combination with electron donors and electron-transfer agents. The processes disclosed are particularly useful in providing positive transfer images using negative-working silver halide emulsions.

106 Claims, No Drawings

PHOTOGRAPHIC ELEMENTS CONTAINING BALLASTED ELECTRON-ACCEPTING NUCLEOPHILIC DISPLACEMENT COMPOUNDS

This invention relates to new compounds, photographic elements, processes for forming image records in photographic elements and new means for obtaining cleavage of a group on a compound. In one aspect, this invention relates to materials which are immobile or ballasted compounds as incorporated into a photographic element but undergo reaction to release diffusible dye-providing moieties or photographic reagents. In another aspect, this invention relates to image dye-providing materials which can be used in image-transfer film units.

It is known in the art to use image dye-providing materials in photographic elements such as image-transfer film units. Image dye-providing materials which are initially mobile in the film units have been employed, for example, such as the mobile couplers and developers disclosed by Land, U.S. Pat. No. 2,698,244 issued Dec. 28, 1954, where a dye is synthesized in the receiver layer. Preformed mobile dyes which reacted with mobile oxidized color developers are disclosed in U.S. Pat. No. 2,774,668. Further disclosures of the use of mobile preformed dyes are found in U.S. Pat. No. 2,983,606 by Rogers issued May 8, 1961. However, the initially mobile image dye-providing materials have certain disadvantages in photographic elements: they can diffuse prematurely to adjacent layers affecting interimage color reproduction and they remain reactive after development when diffusing through adjacent layers where they can react to cause drop-off in color scales.

Image-transfer processes were also proposed where an image dye-providing compound is present in its insolubilized form and is changed to a more soluble form in an imagewise pattern to provide a diffusible imagewise distribution of dye. The use of insolubilized dye developers is proposed in U.S. Pat. No. 3,185,567 where an insoluble dye developer is rendered imagewise-soluble as an inverse function of silver halide development by an auxiliary silver halide developing agent. The resulting soluble compounds also remain reactive as they diffuse through adjacent layers after development where they can react to cause drop-off in color scales. It is also contemplated to incorporate hydrolyzable groups in the dye developers so that, after solubilization of the compound, hydrolysis will occur to release a smaller dye for transfer to the image-receiving layer.

Image dye-providing materials which are initially immobile in a photographic element or are ballasted overcome several of the problems with initially mobile compounds. The dye-providing compounds can be temporarily ballasted by a heavy counter ion such as a barium salt as disclosed by Yutzy, U.S. Pat. No. 2,756,142 issued July 24, 1956. The dye-providing materials contain a removable ballast group as described by Whitmore, Canadian Pat. No. 602,607 issued Aug. 2, 1960, U.S. Pat. Nos. 3,227,552 by Whitmore issued Jan. 4, 1966, 3,628,952, 3,728,113, 3,725,062, and the like. Compounds which undergo intramolecular ring closure upon oxidation to split off a dye are disclosed in U.S. Pat. Nos. 3,443,939, 3,443,940 and 3,443,941, all issued May 13, 1969, and 3,751,406 issued Aug. 7, 1973. Initially immobile compounds which undergo a redox reaction followed by alkali cleavage to split off a dye or dye-precursor moiety are disclosed by Fleckenstein et al, published U.S. Ser. No. B351,673 filed Apr. 16, 1973. However, these image dye-providing materials are generally limited in application by the fact that the dye is released in proportion to imagewise oxidation. Thus, direct-positive silver halide emulsions or some other reversing mechanism, such as use of physical development nuclei in layers adjacent the recording layer, are used if a positive transfer image is desired.

Positive-working immobile compounds for use in photographic elements are the subject of U.S. Ser. No. 534,966 by Hinshaw and Condit filed Dec. 20, 1974, and U.S. Pat. No. 3,980,479 by Fields et al. Generally, the compounds disclosed are immobile ballasted compounds that can undergo a reaction such as an intramolecular nucleophilic displacement reaction to release a mobile and diffusible photographically useful group.

While the chemistry just described has many advantages, it is still desirable to improve the properties and capabilities of positive-working compounds so that there is more freedom of design and latitude in making photographic elements and processes. It would be desirable to provide compounds which have better stability in the photographic element before and after processing. It is also desirable to provide better means of controlling the release of the photographically useful moiety. Generally, the compounds and processes of this invention provide many such advantages over the prior-art processes.

We have now discovered new photographic elements and processes that provide several improvements. Generally, the new photographic elements are based on a ballasted compound that undergoes intramolecular nucleophilic displacement to release a diffusible moiety, and said compound contains a precursor for the nucleophilic group which must accept at least one electron before the compound can undergo the intramolecular nucleophilic displacement. In photographic processes, the compounds of this invention are useful in combination with an electron donor, i.e., reducing agent, which provides the necessary electrons to enable the compound to be reduced to a form which will undergo intramolecular nucleophilic displacement. When the electron donor is provided in an imagewise distribution in the photographic element, electrons are provided by the donor in such imagewise pattern to the ballasted electron-accepting nucleophilic displacement compound with subsequent imagewise displacement of the diffusible moiety.

In the broad aspects of this invention, we have discovered a new means for obtaining cleavage of a group on a compound. This group is designed to undergo intramolecular nucleophilic displacement after accepting at least one electron to provide the nucleophile. Thus, precursors for active compounds can be made where the compound becomes active upon cleavage or the physical properties such as solubility, diffusibility, light absorption, etc., may be changed upon cleavage. This new cleavage means offers a new process advantage since it is controlled by reduction, followed by intramolecular nucleophilic displacement before cleavage occurs. While this cleavage means has been found to be particularly attractive for photographic embodiments where organic reducing agents are used, it can also be used to release several other types of compounds, such as corrosion inhibitors, oxidation inhibitors, pharmaceutical compounds, and the like. Generally, the improved cleavable groups of this invention can be attached to any molecule where it is known to attach releasable groups through an oxygen atom, sulfur atom, amino group or selenium atom of said compound.

We have now found that electron donors and certain electron-accepting compounds can be used to provide high-quality image records, even though the reaction rates of compounds of this general category would not be expected to favor production of large quantities of the desired end product. While the theory of the present reactions has not been fully verified, it does appear that one explanation for the results now attained is that compounds which undergo intramolecular nucleophilic displacement effectively shift the redox equilibrium by rapid removal of one of the products. Generally, the basic redox equilibria reactions are written:

$$\text{eletron donor} + \text{electron-accepting image dye-providing compound} \underset{k_2}{\overset{k_1}{\rightleftharpoons}} \text{reduced image dye-providing compound} + \text{oxidized electron donor}$$

The equilibrium constant K must highly favor production of a large quantity of useful image dye-providing material for an efficient process. While processes of this type may have the potential for some image discrimination, they have not proven to be very practical. However, the compounds of this invention which undergo intramolecular nucleophilic displacement appear to overcome the limitations previously encountered with this process because the rapid intramolecular nucleophilic displacement reaction effectively removes one of the components from the equilibrium, thus pulling the reaction in that direction and favoring the production of products on the right.

The electron-accepting, nucleophilic displacement compounds of the present invention which we have found to be particularly useful in photographic processes and photographic elements can generally be represented by the following schematic formula:

$$(\text{Ballasted Carrier})_x - (\text{Electrophilic Cleavage Group})_y - (\text{Diffusible Moiety})_z$$

where x, y and z are positive integers and preferably are 1 or 2; which includes compounds having more than one diffusible group attached to one ballast group or more than one ballast attached to one diffusible group; Ballasted Carrier is a group which is capable of rendering said compound immobile in alkali-permeable layers of a photographic element under alkaline processing conditions; and the Diffusible Moiety is a photographic reagent or an image dye-providing moiety; wherein said compound contains an Electrophilic Cleavage Group in each linkage connecting the ballasted carrier to the respective diffusible moiety, and one of said ballasted carriers or said diffusible moieties contains a group which, upon acceptance of at least one electron, provides a nucleophilic group capable of undergoing intramolecular nucleophilic displacement with said electrophilic cleavage group. Upon cleavage of the electrophilic cleavage group, part of the group will remain with the ballasted carrier and part of the group will remain with the diffusible moiety. The compounds of the above formula are referred to in this application as BEND compounds which is an acronym for Ballasted Electron-Accepting Nucleophilic Displacement compounds.

When a BEND compound is used in a photographic element or process, the compound reacts with an electron donor to provide a nucleophilic group which in turn functions by reaction at the electrophilic center of the electrophilic cleavage group, displacing the ballasted carrier from the diffusible moiety. The diffusible moiety, upon release from the ballasted carrier(s), can then diffuse within the immediate layer, to adjacent layers or to receiving layers where it can carry out its intended function. However, where there are no electrons transferred to the electron-accepting nucleophile precursor, it remains incapable of displacing the diffusible group and is stable, remaining in its initial location. An imagewise distribution of electron donor can be obtained in a photographic element by destroying the electron donor in an imagewise pattern before it has reacted with the BEND compound, leaving an inverse distribution of the electron donor for subsequent reaction. In those instances where the electron donor is a silver halide developing agent, it will be destroyed where it first reacts with developable silver halide. In other instances, such as where the electron donor is not an effective silver halide developer, electron transfer agents can be used which are good silver halide developing agents and which react with the electron donor before it reacts with the BEND compound to provide an inverse imagewise distribution of electron donor. In the preferred embodiments of this invention, an electron-transfer agent is used in combination with the electron donor and the ballasted electron-accepting nucleophilic displacement compound; this feature provides for optimizing the development rate of the image-recording silver halide emulsion substantially independently of the optimization of the release rate of diffusible moiety. The compounds of the present invention may also be synthesized more efficiently and provide more latitude in the parameters of the imaging process than many other compounds proposed for image-transfer processes.

In one embodiment, this invention relates to photographic elements comprising at least one alkali-permeable layer containing a photographic recording material such as silver halide having associated therewith a BEND compound. Preferably, the BEND compound comprises an image dye-providing group which is a dye, including a shifted dye, or a dye precursor, such as an oxichromic compound or a color coupler and the like.

In a preferred embodiment, this invention relates to photographic elements which comprise a layer containing a red-sensitive silver halide emulsion having associated therewith a BEND compound comprising a diffusible cyan image dye-providing moiety, a layer containing a green-sensitive silver halide emulsion having associated therewith a BEND compound which comprises a diffusible magenta image dye-providing moiety, and a layer containing a blue-sensitive silver halide emulsion having associated therewith a BEND compound which comprises a diffusible yellow image dye-providing moiety.

In another highly preferred embodiment, this invention relates to image-transfer systems which comprise a silver halide emulsion having associated therewith a BEND compound which preferably comprises an image dye-providing moiety which is a preformed dye or a shifted dye.

In a specific embodiment in accordance with this invention, a photographic film unit is provided which is adapted to be processed by passing said unit between a pair of juxtaposed pressure-applying members, such as would be found in a camera designed for in-camera processing. The unit comprises (1) a photosensitive element which contains a silver halide emulsion having associated therewith a BEND compound, (2) an image-receiving layer in alkaline-permeable relationship with said silver halide emulsion, (3) means for discharging an alkaline processing composition within the film unit such as a rupturable container which is adapted to be positioned during processing of the film so that a compressive force applied to the container by the pressure-applying members will effect a discharge of the container's contents within the film, and (4) either (i) an electron donor which is a silver halide developer or (ii) an electron donor in combination with an electron transfer agent which is a silver halide developing agent located within said film unit.

In still another embodiment, this invention relates to a new process comprising (1) applying an alkaline processing composition to an imagewise-exposed photographic element comprising at least one layer containing a photographic recording material, such as silver halide, and at least one layer containing a BEND compound, and (2) providing an electron donor or both an electron donor and an electron-transfer agent during application of said alkaline processing composition under conditions to develop an imagewise pattern of said silver halide as a function of exposure and to effect imagewise release of said diffusible moiety as an inverse function of development of said photographic recording material, whereby an image record is obtained in said photographic element.

In a highly preferred embodiment, this invention relates to photographic transfer process comprising:

(a) treating a photographic element prepared in accordance with this invention with an alkaline processing composition in the presence of a silver halide developing agent to effect development of each of the exposed silver halide emulsion layers and provide an inverse imagewise distribution of electron donor; and (b) reducing said BEND compound according to this invention as an inverse function of oxidation of the electron donor, whereby release of a diffusible moiety occurs to provide an image record.

In the embodiment next above, the diffusible moiety is preferably an image dye or image-dye precursor. The image-transfer process is preferably carried out in an integral imaging receiver element where the image-receiving layer and the photographic recording layers are coated on the same support, preferably with an opaque light-absorbing layer and a layer which is reflective to light located between the receiver layer and the recording layers; the alkaline processing composition can be applied between the outer recording layers of the photographic element and a cover sheet which can be transparent and superposed before exposure. In this embodiment, the combination of the opaque light-absorbing layer and reflective layer is designed to provide sufficient opacity to preclude adverse exposure through these layers during roomlight processing of the film unit. The alkaline processing composition also preferably contains sufficient opacifying materials such as dyes or pigments to preclude adverse exposure through this layer after being spread over the photographic element.

The photographic elements of this invention can also be designed for use in multiple-step processes. In one step, the imagewise pattern of electron donor can be obtained under conditions which will not affect the BEND compound. In a subsequent step, which may occur after storage for an indefinite period of time, the element can then be subjected to conditions which promote the electron transfer between the imagewise pattern of electron donor and the BEND compound. The second step can be carried out by subjecting the element to a change in condition or environment such as heat, liquid composition, vapors, etc., or combinations thereof which will promote the electron-transfer reaction and subsequent release of the diffusible moiety.

Positive retained images can also be readily obtained in photographic elements that contain BEND compounds and hydrolyzable electron donors in accordance with this invention. The elements can be first developed with a developing agent that does not react with BEND, or development can take place in an environment having a pH below that necessary to hydrolyze the electron donor in said element; then the photographic element can be fogged, light-flashed, etc., and developed in the presence of an electron donor or in a solution having a pH sufficiently high to effect hydrolysis of the electron donor wherein it will donate electrons to the BEND compound as an inverse function of the second development, causing intramolecular nucleophilic displacement of the diffusible moiety from the BEND compound. In highly preferred embodiments, the BEND compounds used to obtain high image quality in a retained image process, i.e., in or adjacent the exposed silver halide layers, are quinone-type compounds which accept electrons to provide a nucleophilic hydroxy group.

Generally, the BEND compounds of this invention are precursors for compounds which function in the photographic element as intramolecular nucleophilic displacement compounds. The term "intramolecular nucleophilic displacement" is understood to refer to a reaction in which a nucleophilic center on a molecule reacts at another site in said molecule, which is an electrophilic center, to effect displacement of a group or atom attached to said electrophilic center. The term "nucleophilic displacement" is intended to refer to a mechanism where a portion of the molecule is actually displaced rather than merely relocated on the molecule; i.e., the electrophilic center must be capable of forming a ring structure with said nucleophilic group. Generally, the intramolecular nucleophilic displacement compounds are those compounds that have the nucleophilic group and the electrophilic group juxtaposed in the three-dimensional configuration of the molecule in close proximity whereby the intramolecular reaction can take place. The respective electrophilic and nucleophilic groups can be used in any compound where the groups are held in the possible reaction positions, including polymeric compounds, macrocyclic compounds, polycyclic compounds, enzyme-like structures and the like. However, the nucleophilic groups and electrophilic groups are preferably located in any organic compounds wherein a cyclic organic ring or a transient organic ring can be easily formed by intramolecular reaction of the nucleophilic group at the electrophilic center. Rings can be generally formed with 3–7 atoms therein, and preferably in accordance with the compounds of this invention the nucleophilic group and the electrophilic group are positioned in a compound where they can form a 3- or 5- to 7-membered ring, more preferably a 5- or 6-membered ring (4-membered rings are generally known to be difficult to form in organic reactions). Intramolecular nucleophilic displacement occurs with the compounds of this invention after the nucleophilic precursor has accepted at least one electron. The rate of nucleophilic displacement is very low or substantially zero prior to reduction of the nucleophile precursor group.

It should be understood that the compounds of this invention are stable under the conditions of processing except where the primary cleavage of the compound occurs as a direct function of the reduction of a nucleophile precursor group. The compound may contain other groups which ionize or hydrolyze, but the primary imagewise release occurs by reaction of the imagewise distribution of nucleophilic group(s) on the BEND compounds with the cleavage group(s) on the compound. It is understood that, where the BEND compounds are to be used in highly alkaline conditions, the various groups of the BEND compound are selected to provide compounds which are relatively stable to external attack by alkali, such as those exemplified in Compounds 1–21 in the examples that follow.

The compounds of this invention contain the nucleophilic precursor groups and the electrophilic cleavage groups connected through a linkage which can be acyclic, but is preferably a cyclic group to provide more favorable juxtaposition of the groups whereby intramolecular nucleophilic attack on the electrophilic center is favored. In certain highly preferred embodiments, the nucleophilic precursor group and the electrophilic group are both attached to the same aromatic ring structure, which can be a carbocyclic ring structure or a heterocyclic ring structure and includes fused rings wherein each group can be on a different ring; preferably, both groups are attached directly to the same aromatic ring, which is preferably a carbocyclic ring structure.

In certain embodiments, the compounds of this invention contain from 1 to about 5 atoms and preferably 3 or 4 atoms between the nucleophilic center of the nucleophilic group and the atom which forms the electrophilic center, whereby the nucleophilic center, taken together with the center of the electrophilic group, is capable of forming a ring or a transient ring having from 3–7 atoms therein and preferably 5 or 6 atoms therein.

In certain embodiments, the BEND compounds useful in this invention have the formula:

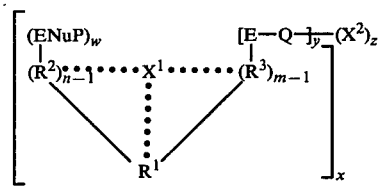

where w, x, y, z, n and m are positive integers of 1 or 2; ENuP is an electron-accepting nucleophilic group precursor such as precursors for hydroxylamino groups including nitroso groups (NO), stable nitroxyl free radical (N—O·), and preferably nitro groups ($NO_2$), or precursors for hydroxy groups which are preferably oxo (=O) groups, or they can also be imine groups which are hydrolyzed to oxo groups before accepting electrons in an alkaline environment, $R^1$ is an acyclic organic group or preferably is a cyclic organic group including bridged-ring groups, polycyclic groups and the like, which preferably have from 5–7 members in the ring to which ENuP and E are attached, $R^1$ being preferably an aromatic ring having 5–6 members in the ring and is a carbocyclic ring, e.g., benzenoid groups, etc., or $R^1$ is a heterocyclic ring including nonaromatic rings where ENuP is part of the ring, i.e., where ENuP is a nitroxyl group with the nitrogen atom in the ring, and generally $R^1$ contains less than 50 atoms and preferably less than 15 atoms; $R^2$ and $R^3$ are bivalent organic groups containing from 1–3 atoms in the bivalent linkage and can be alkylene groups, oxoalkylene thiaalkylene, iminoalkylene, alkyl- or aryl-substituted nitrogen and the like, including large groups in side chains on said linkage which can function as a ballast, e.g., groups containing at least 8 carbon atoms and which groups will be $X^1$ when $X^1$ is a Ballast group; E and Q provide an electrophilic cleavage group where E is an electrophilic center and is preferably a carbonyl group including carbonyl (—CO—) and thiocarbonyl (—CS—) or it can be a sulfonyl group; Q is a bivalent group providing a mono atom linkage between E and $X^2$ wherein said mono atom is a nonmetallic atom of group VA or VIA of the periodic table in its −2 or −3 valence state, such as an oxygen atom, a sulfur atom and a selenium atom and is preferably a nitrogen atom which provides an amino group, wherein said atom provides the two covalent bonds linking $X^2$ to E, and when it is a trivalent atom it can be monosubstituted with a hydrogen atom, an alkyl group containing from 1–20 atoms and preferably 1–10 carbon atoms, including substituted carbon atoms and carbocyclic groups, or an aryl group containing from 6–20 carbon atoms including substituted aryl groups; $X^1$ is a substituent on at least one of $R^1$, $R^2$ and $R^3$, and one of $X^1$ or Q—$X^2$ represents one or more ballasting groups of sufficient size to render said compound immobile in an alkali-permeable layer of a photographic element, and one of $X^1$ and Q—$M^2$ is a photographically useful moiety such as an image dye, an image-dye precursor, or a photographic reagent such as an antifoggant moiety, a toner moiety, a fixing agent, a development accelerator, a developing-agent moiety, a hardener moiety, a development-inhibitor moiety and the like, including the necessary linking groups to attach the respective moiety to E or $R^1$; and $R^1$, $R^2$ and $R^3$ are selected to provide substantial proximity of ENuP to E to permit intramolecular nucleophilic cleavage of Q from E and are preferably selected to provide 1 or 3 to 5 atoms between the atom which is the nucleophilic center of the nucleophilic group and the atom which is the electrophilic center, whereby said compound is capable of forming a 3- or 5- to 7-membered ring and most preferably a 5- or 6-membered ring upon intramolecular nucleophilic displacement of the group Q—$X^2$ from said electrophilic group.

In the compounds of the above formula, the stability and cleavage rates of the electrophilic cleavage group can be modified by the use of certain atoms or groups in the linkages adjacent the ⊣E—Q⊢ group. In certain instances, it is desirable to have an amino group in $R^3$ next to E, especially when E is a carbonyl group and ENuP is an oxo group. In certain embodiments, it is also desirable to have certain groups next to Q in the linkage; i.e., ⊣Q—$X^2$) becomes the group ⊣Q—$R^9$—$X^3$) where $R^9$ is a group such as an aromatic group as defined later herein.

In the above formula where Q—$X^2$ is the photographically useful moiety, a photographically active group can be made available by Q upon cleavage of this moiety from the remainder of the compound, i.e., such as where Q—$X^2$ forms a mercaptotetrazole and the like.

However, where $X^1$ is the photographically useful group, the group should be attached in a manner so that it does not rely upon the cleavage to provide the activity of the photographically useful species.

The nature of the ballasting groups in the above compounds is not critical as long as the portion of the compound on the ballast side of E is primarily responsible for the immobility; the other portion of the molecule on the remaining side of E generally contains sufficient solubilizing groups to render it mobile and diffusible in an alkaline medium after cleavage. Thus, $X^1$ could be a relatively small group if the remainder of $R^1$, $R^2$ and $R^3$ confers sufficient insolubility to the compound to render it immobile. However, when $X^1$ or $+Q—X^2)$ serve as the ballast function, they generally comprise long-chain alkyl radicals, as well as aromatic radicals of the benzene and naphthalene series. Typical useful groups for the ballast function contain at least 8 carbon atoms and preferably at least 14 carbon atoms. Where $X^1$ is a ballast, it can be one or more groups substituted on $R^1$, $R^2$ or $R^3$ which confer the desired immobility. Thus, for example, two small groups, such as groups containing from 5–12 carbon atoms, can be used to achieve the same immobility as one long ballast group containing from 8–20 carbon atoms. Where multiple ballast groups are used, it is sometimes convenient to have an electron-withdrawing group linkage between the major part of the ballast group and an aromatic ring to which it is attached, especially when the electron-accepting nucleophilic precursor is a nitro substituent on said ring.

The term "nucleophilic group" as used herein refers to an atom or group of atoms that have an electron pair capable of forming a covalent bond. Groups of this type are sometimes ionizable groups that react as anionic groups. The term "electron-accepting nucleophile precursor group" refers to that precursor group that, upon accepting at least one electron, i.e., in a reduction reaction, provides a nucleophilic group. The electron-accepting nucleophile precursor groups are less nucleophilic in character than the reduced group or have a structure that adversely affects the proximity of the nucleophilic center with respect to the electrophilic center.

The nucleophilic group can contain only one nucleophilic center such as the oxygen atom in an hydroxy group, or it can contain more than one atom which can be the nucleophilic center such as in the case of an hydroxylamino group where either the nitrogen atom or the oxygen atom can be the nucleophilic center. Where more than one nucleophilic center is present in the nucleophilic group on the intramolecular nucleophilic displacement compounds of this invention, the nucleophilic attack and displacement will generally occur through the center which is capable of forming the most favored ring structure; i.e., if the oxygen atom of the hydroxylamino group would form a 7-membered ring and the nitrogen atom would form a 6-membered ring, the active nucleophilic center would generally be the nitrogen atom.

The term "electrophilic group" refers to an atom or group of atoms that are capable of accepting an electron pair to form a covalent bond. Typical electrophilic groups are sulfonyl groups ($—SO_2—$), carbonyl (—CO—) and thiocarbonyl (—CS—) and the like, where the carbon atom of the carbonyl group forms the electrophilic center of the group and can sustain a partial positive charge. The term "electrophilic cleavage group" is used herein to refer to a group (—E—Q—) wherein E is an electrophilic group and Q is a bivalent leaving group providing a mono atom linkage between E and $X^2$ wherein said mono atom is a nonmetallic atom that has a negative valence of 2 or 3. The leaving group is capable of accepting a pair of electrons upon being released from the electrophilic group. Where the nonmetallic atom is a trivalent atom, it can be monosubstituted by a group which can be a hydrogen atom, an alkyl group including substituted alkyl groups and cycloalkyl groups, or an aryl group including substituted aryl groups. Typical atoms useful in Q are the nonmetallic atoms in groups VA and VIA of the periodic table which are capable of having a negative valence of 2 or 3, such as nitrogen atoms, sulfur atoms, oxygen atoms, selenium atoms and the like.

The BEND compounds of this invention can contain substituents which alter the rate of reaction of the compound. In one highly preferred embodiment, substituents are located on the cyclic aromatic group represented by $R^1$ to improve the reaction rates when the compound is used in an image-transfer film unit. In certain preferred embodiments, especially when ENuP is a nitro group, the aromatic ring to which ENuP and $X^1$ are attached contains at least one and preferably two electron-withdrawing groups thereon which have a positive Hammett sigma value such as a sulfonyl group and the like.

In those instances where electron-withdrawing substituents are located on $R^1$, the BEND compound generally undergoes reduction more easily; thus, a wider variety of electron donors can be used with the BEND compounds. However, with other BEND compounds stronger electron donors may be necessary to achieve a fast rate of reduction of the BEND compound. In one embodiment where the nucleophilic precursor group is a nitro group, at least two electron-withdrawing groups are used on the aromatic ring to achieve the desired rate of reduction with the preferred benzisoxazolone electron donors.

The term "nondiffusing" used herein has the meaning commonly applied to the term in photography and denotes materials that for all practical purposes do not migrate nor wander through organic colloid layers such as gelatin in an alkaline medium, in the photographic elements of the invention and preferably when processed in a medium having a pH of 11 or greater. The same meaning is to be attached to the term "immobile." The term "diffusible" as applied to the materials of this invention has the converse meaning and denotes materials having the property of diffusing effectively through the colloid layers of the photographic elements in an alkaline medium in the presence of "nondiffusing" materials. "Mobile" has the same meaning.

In certain embodiments, the BEND compounds useful in accordance with the invention are ballasted compounds having the structure:

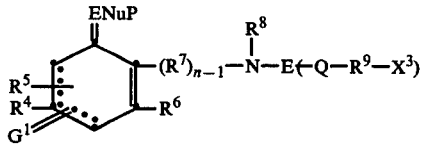

wherein ENuP is an electron-accepting nucleophilic precursor for an hydroxy nucleophilic group including imino groups and preferably oxo groups; $G^1$ is an imino including alkylimino groups, sulfonimido groups, cyclic groups formed with $R^4$ or $R^6$ or any of the groups specified for ENuP, and preferably $G^1$ is para to the ENuP group above in the formula; E is an electrophilic group which can be carbonyl —CO— or a thiocarbonyl —CS— group and is preferably carbonyl; Q is a bivalent group providing a mono atom linkage between E and $R^9$ wherein said mono atom is a nometallic atom of group VA or VIA of the periodic table in its −2 or −3 valence state, such as a nitrogen atom, an oxygen atom, a sulfur atom, a selenium atom and the like, wherein said atom provides two covalent bonds linking E to $R^9$, and when it is a trivalent atom it can be mono-substituted with a hydrogen atom, an alkyl group containing from 1–10 carbon atoms including substituted alkyl groups, aromatic groups containing 5–20 carbon atoms including aryl groups and substituted aryl groups and the like; $R^7$ is an alkylene group containing from 1–3 carbon atoms in the linkage including alkylene groups having substituents thereon, and preferably is an alkylene group containing 1 carbon atom in the bivalent linkage; n is an integer of 1 or 2; $R^9$ can be an aromatic group containing from 6–20 carbon atoms including heterocyclic groups, for example, groups containing a nucleus such as pyridine, isoquinoline and the like, or a carbocyclic arylene group which is preferably a phenylene group or a naphthylene group including substituted phenylene and naphthylene groups, or $R^9$ can be an alkylene group containing from 1–12 carbon atoms, including substituted alkylene groups and the like; $R^8$ can be an alkyl group containing from 1–40 carbon atoms, including substituted alkyl groups and cycloalkyl groups, an aryl group containing from 6–40 carbon atoms, including substituted aryl groups and the like, or it can be the substituent $X^1$; $R^6$, $R^4$ and $R^5$ can each be mono atom substituents such as hydrogen or halogen atoms or preferably poly atom substituents such as an alkyl group containing from 1–40 carbon atoms, including substituted alkyl groups and cycloalkyl groups, an alkoxy group, an aryl group containing from 6–40 carbon atoms, including substituted aryl groups, a carbonyl group, a sulfamyl group, a sulfonamido group and the like, or they can each be the substituent $X^1$ with the provision that $R^6$ and $R^5$ or $R^4$ and $R^5$, when they are on adjacent positions of the ring, may be taken together to form a 5- to 7-membered ring with the remainder of the molecule including bridged rings and the like, and with the provision that, when $R^9$ is an alkylene group, $R^6$ and $R^4$ must be poly atom substituents, and preferably $R^5$ is a poly atom substituent, and when $G^1$ is an electron-accepting nucleophilic precursor group as defined for ENuP, the $R^4$ or $R^6$ substituent adjacent $G^1$ can be the group:

$$\left(R^7\right)_{N-1}-\overset{\overset{\displaystyle R^8}{|}}{N}-E\left(Q-R^9-X^3\right)$$

to provide a compound which has multiple groups which can be released by nucleophilic displacement; $X^1$ is provided in at least one of the substituted positions and each of $X^1$ and $\left(Q-R^9-X^3\right)$ can be a ballasting group of sufficient size to render said compound immobile in an alkali-permeable layer of a photographic element, or a photographically useful moiety, provided one of $X^1$ and $\left(Q-R^9-X^3\right)$ is a ballast group and the other is a photographically useful moiety, such as a photographic reagent, or preferably is an dye-providing material such as an image dye or an image-dye precursor; and $R^7$ is selected to provide substantial proximity of the nucleophilic group to E to permit intramolecular nucleophilic cleavage of Q from E, and is preferably selected to provide 3–5 atoms between the atom which is the nucleophilic center of said nucleophilic group and the atom which is the electrophilic center of said electrophilic group, whereby said compound is capable of forming a 5- to 8-membered ring and most preferably a 5- or 6-membered ring upon intramolecular nucleophilic displacement of the group $\left(Q-R^9-X^3\right)$ from said electrophilic group. Typical useful compounds of this type are Compounds BEND 1 to 6 in the examples that follow.

BEND compounds having the structure shown next above can be prepared by procedures well-known in the art. Typically, a dialkylhydroquinone is prepared by methods disclosed, for example, in U.S. Pat. Nos. 2,360,290 by Vittum and Wilder issued Oct. 10, 1944, and 2,732,300 by Thritle et al issued Jan. 24, 1956, and by Armstrong et al, *J. Am. Chem. Soc.*, 82, 1928–1935 (1960). The hydroquinone is converted as desired to a mono- or dibenzoxazine by any suitable method. One useful means is described by Fields et al, *J. of Org. Chem.*, 27, 2740 (1962). An applicable process for making monobenzoxazines is disclosed by Reynolds and Cossar, U.S. Pat. No. 3,825,538 issued July 23, 1974. The desired mono- or dibenzoxazine is hydrolyzed to the corresponding aminomethylhydroquinone or di(aminomethyl)hydroquinone, typically by treatment with HCl in methanol. The aminoalkyl group(s) are acylated with an appropriate chloroformate such as a nitrophenyl chloroformate and the nitro group is catalytically reduced to the corresponding amino group. The resulting aminophenyloxycarbonylaminomethylhydroquinone is oxidized to the corresponding quinone with an oxidizing agent such as lead dioxide or manganese dioxide. Appropriate dye fragments having reactive acid chloride groups, for example, are then reacted with the above-described quinones to provide BEND compounds of the invention having an electron-accepting nucleophilic precursor for a nucleophilic group such as an oxo group.

In certain preferred embodiments, the compounds of this invention are BEND compounds which have the formula:

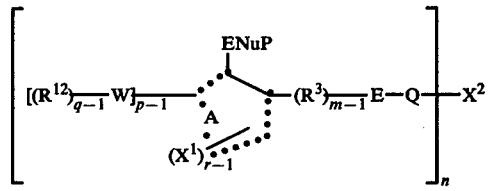

where ENuP is an electron-accepting precursor for an hydroxylamino group such as nitroso (NO), stable nitroxyl radicals and preferably nitro groups ($NO_2$); A represents a group containing the atoms necessary to form a 5- to 6-membered aromatic ring with the remainder of said formula, including polycyclic aromatic-ring structures, and wherein the aromatic rings can be carbocyclic rings or heterocyclic rings such as groups containing aromatic 'onium groups in the ring, and A preferably represents the groups necessary to form a carbocyclic ring system such as a benzene ring, a naphthalene ring, etc.; W is an electron-withdrawing group having a positive Hammett sigma value and includes groups such as cyano, nitro, fluoro, chloro, bromo, iodo, trifluoromethyl, trialkyl ammonium, carbonyl, N-substituted carbamoyl, sulfoxide, sulfonyl, N-substituted sulfamoyl, ester and the like; $R^{12}$ is a hydrogen atom, a substituted or unsubstituted alkyl group containing from 1–30 carbon atoms, or a substituted or unsubstituted aryl group containing from 6–30 carbon atoms; $R^3$ is a bivalent organic group containing from 1–3 atoms in the bivalent linkage and can be alkylene groups, oxaalkylene, thioalkylene, iminoalkylene, alkyl or aryl-substituted nitrogen and the like; m and q are positive integers of 1 or 2; p and r are positive integers of 1 or greater and preferably p is 3–4, with $[(R^{12})_q\text{—}]_r W]$ being a substituent on any portion of the aromatic-ring structure of A; E and Q provide an electrophilic cleavage group where E is an electrophilic center and is preferably a carbonyl group including carbonyl (—CO—) and thiocarbonyl (—CS—) or it can be a sulfonyl group, and Q is a bivalent group providing a monoatom linkage between E and $X^2$ wherein said bivalent group can be an oxygen atom, a sulfur atom, a selenium atom, a nitrogen atom which provides an amino group and the like, and preferably Q is an amino group with an alkyl group substituent containing from 1–20 atoms and preferably from 1–10 carbon atoms, including substituted alkyl groups; n is an integer of 1–3 and is preferably 1; $X^2$, together with Q, is either an image dye-providing material such as an image dye or an image dye-precursor or a photographic reagent such as an antifoggant moiety, a toner moiety, a fixing agent, a development accelerator, a developing-agent moiety, a hardener moiety, a development-inhibitor moiety and the like; $X^1$ is a ballasting group as defined above and preferably can be a substituted or unsubstituted alkyl group containing from 8–30 carbon atoms, a substituted or unsubstituted aryl group containing from 8–30 carbon atoms and the like, including the necessary linking groups to the aromatic ring, with the provision that at least one of $X^1$ or $R^{12}$ is present in said compound and is a group of sufficient size to render said BEND compound immobile and nondiffusible in the alkali-permeable layers of a photographic element, i.e., preferably at least one of $X^1$ or $R^{12}$ contains from 12–30 carbon atoms. Typical useful compounds of this type are BEND Compounds 7–22 in the Examples that follow.

It is to be understood that, when multiple groups are present in the compound as designated in the above formula, they may be identical or different; i.e., when p is 3, each ($R^{12}$—W+ may be selected from different substituents as specified.

The electron-withdrawing groups referred to for the compounds of the above formulae generally are those groups which have a positive Hammett sigma value and preferably a sigma value more positive than 0.2 or a combined effect of more than 0.5 as substituents of the aromatic ring. The Hammett sigma values are calculated in accordance with the procedures in *Steric Effects in Organic Chemistry,* John Wiley and Sons, Inc., 1956, pp. 570–574, and *Progress in Physical Organic Chemistry,* Vol. 2, Interscience Publishers, 1964, pp. 333–339.

Typical useful electron-withdrawing groups having positive Hammett sigma values include cyano, nitro, fluoro, bromo, iodo, trifluoromethyl, trialkylammonium, carbonyl, N-substituted carbamoyl, sulfoxide, sulfonyl, N-substituted sulfamoyl, esters and the like. Where the term "aromatic ring having an electron-withdrawing substituent" is used herein, it refers to 'onium groups in the ring and to those groups substituted directly on the ring which may be linkage for other groups such as ballast groups.

The electron-withdrawing groups include groups in the ring such as in a compound of the formula:

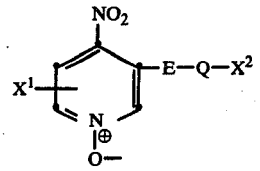

where E, Q, $X^1$ and $X^2$ are as defined above.

In accordance with this invention, an electron donor is used in combination with the BEND compounds to provide the imagewise release of the diffusible moiety. The electron donor is destroyed imagewise before it reacts with the BEND compound; thus, the BEND compound is capable of releasing the diffusible moiety as an inverse function of the destruction of the electron donor.

The term "electron donor" as used herein is understood to refer to those compounds that are capable of reacting with the respective BEND compounds as incorporated in a photographic element to transfer electrons to the nucleophilic precursor group of said BEND compound. Preferably, the electron donor will have a reaction rate with the BEND compound when used in the concentrations and under conditions of processing of the element such that the redox halflife known as redox $t_{\frac{1}{2}}$ is less than 30 minutes, i.e., the time for ½ of the stoichiometrically limiting ingredient to be consumed in the redox reaction when they are used in a ratio of from 1:2 to 2:1 and preferably about a 1:1 ratio.

The terms "redox $t_{\frac{1}{2}}$", "redox $t_{\frac{1}{4}}$", etc., as used herein refer to the time at which ½, ¼, etc., of the limiting ingredient is consumed in the redox reaction under the conditions specified, and where they are not specified it is the condition encountered during processing of the photographic element.

In one embodiment of this invention, the electron donors, used in combination with the BEND compounds, are capable of developing silver halide. Thus, in a photographic element containing a layer of silver halide having a BEND compound associated therewith, the electron donor is destroyed by reaction with the imagewise pattern of silver halide which has been rendered developable after exposure. Generally, in this embodiment any electron donor can be used which has a faster reaction rate with the exposed silver halide than it does with the BEND compound. Preferably, the electron donor in this embodiment has a redox $t_{\frac{1}{2}}$ with the exposed silver halide which is at least 5 times and more preferably at least 10 times faster than the redox $t_{\frac{1}{2}}$ with the respective BEND compound to produce the best photographic results, such as selective image discrimination of the released diffusible moiety. Typical useful electron donors in this embodiment include ascorbic acid, trihydroxypyrimidines such as 2-methyl-4,5,6-trihydroxypyrimidine and hydroxylamines such as diethylhydroxylamine.

In certain preferred embodiments, the electron donor is used in combination with an electron-transfer agent (herein referred to as ETA). Generally, the electron-transfer agent is a compound which is a much better silver halide developer under the conditions of processing than the electron donor and, in those instances where the electron donor is incapable of or substantially ineffective in developing the silver halide, the ETA functions to develop the silver halide and provide a corresponding imagewise pattern of destroyed electron donor because the oxidized ETA readily accepts electrons from the donor. Generally, the useful ETA's will at least provide a faster rate of silver halide development under the conditions of processing when the combination of the electron donor and the ETA is employed as compared with the development rate when the electron donor is used in the process without the ETA. In highly preferred embodiments, the ETA has a slow redox $t_{\frac{1}{2}}$ with BEND which is at least slower than the redox $t_{\frac{1}{2}}$ of the electron donor with BEND and preferably at least 10 times slower; this embodiment allows a high degree of freedom in obtaining the optimum silver halide developing rates while also providing freedom in obtaining the optimum release rates with the BEND compounds.

Typical useful ETA compounds include hydroquinone compounds such as hydroquinone, 2,5-dichlorohydroquinone, 2-chlorohydroquinone and the like; aminophenol compounds such as 4-aminophenol, N-methylaminophenol, 3-methyl-4-aminophenol, 3,5-dibromoaminophenol and the like; catechol compounds such as catechol, 4-cyclohexylcatechol, 3-methoxycatechol, 4-(N-octadecylamino)catechol and the like; phenylenediamine compounds such as N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine and the like. In highly preferred embodiments, the ETA is a 3-pyrazolidone compound such as 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis-(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(3-chlorophenyl)-3-pyrazolidone, 1-(4-chlorophenyl)-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone and the like; etc. A combination of different ETA's such as those disclosed in U.S. Pat. No. 3,039,869 can also be employed. Such developing agents can be employed in the liquid processing composition or may be contained, at least in part, in any layer or layers of the photographic element or film unit such as the silver halide emulsion layers, the dye image-providing material layers, interlayers, image-receiving layer, etc. The particular ETA selected will, of course, depend on the particular electron donor and BEND used in the process and the processing conditions for the particular photographic element.

In the photographic elements of this invention, the electron donors are preferably effectively isolated with respect to one of the image-providing layer units, i.e., such as with a multicolor photographic element that has separate yellow, magenta and cyan image dye-providing layer units. The isolation can be accomplished by using scavengers in the interlayers separating the respective layer units. The appropriate scavengers for the diffusible or partially diffusible compounds in either their oxidized or reduced states can be used to reduce interimage contamination. In certain preferred embodiments, effective isolation is achieved by incorporating in the layer unit partially or fully ballasted electron donors. The interlayer diffusion is effectively reduced when substantially immobile electron donors are used; however, the compounds remain effective within the layer unit to transfer electrons to the BEND compounds associated therewith.

Generally, the electron donors which are preferred are those which are semi-immobile or can be isolated in the layer unit until imagewise discrimination is substantially complete. After the imaging process is substantially complete, migration of small amounts of the electron donor to adjacent layer units will not generally have a substantial adverse effect because it will be consumed by development of the remaining previously undeveloped silver halide. In certain embodiments, the semi-immobile electron donors are characterized as having a reaction time with the BEND compound which is at least twice as long, and preferably 3 to 6 times as long, under alkaline processing conditions when the electron donor is coated in a contiguous alkali-permeable layer at 3 times the concentration as compared with the electron donor coated in the same layer as the BEND compound in a stoichiometric equivalent concentration. In exemplary tests, the electron donor and BEND compound are coated in layers containing gelatin at 20 mg./m.$^2$ and the completion of reaction is monitored in terms of release of one-half of the dye or photographic agent from the BEND compound.

In those embodiments where a very high degree of imagewise discrimination is desirable, such as in multicolor photographic elements, an alkali-labile electron-donor precursor is used in combination with the respective BEND compound. Generally, hydrolysis of the electron-donor precursor will occur at a certain finite rate and, as the electron donor is produced, it will react readily with the oxidized ETA made available during the silver halide development reaction or with the developable silver halide. ETA can be regenerated to develop more silver halide and, in those areas where development is occurring, electron donor is being destroyed as fast as it is produced by hydrolysis. Thus, the electron donor made available by hydrolysis is available only in the areas of nondevelopment for reaction with BEND to release the diffusible moiety such as the diffusible image dye. In most preferred embodiments, the alkali-labile electron-donor precursor contains sufficient ballast groups to render it substantially immobile, especially when used in multicolor photographic elements.

In the embodiments where alkali-labile electron-donor precursors are employed, it appears that the rate of hydrolysis of the electron-donor precursor is the rate-limiting step with respect to release of the diffusible moiety from BEND and it also has an effect on silver halide development rate, especially where small amounts of the ETA are employed. Thus, those alkali-labile precursors are generally used which provide a redox $t_{\frac{1}{2}}$ of longer than 5 seconds and preferably longer than 10 seconds with the respective BEND compound.

The electron donors are generally used in the photographic elements in a ratio of 1:2 to 2:1 of electron donor to BEND compound.

In certain preferred embodiments, the alkali-labile electron-donor precursors have the formula:

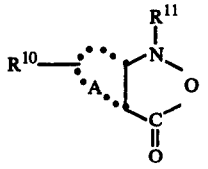

wherein A represents a group containing the atoms necessary to form an aromatic ring containing from 5–6 atoms with the remainder of said formula and preferably a carbocyclic aromatic ring, $R^{10}$ represents a hydrogen atom or one or more groups containing from 1–30 carbon atoms and preferably of a size sufficient to render said compound at least semi-immobile in the alkali-permeable layers of a photographic element such as groups containing from 8–30 carbon atoms, including N-substituted carbamoyl groups such as N-alkylcarbamoyl, alkylthioether groups, N-substituted sulfamoyl groups such as N-alkylsulfamoyl, alkoxycarbonyl groups and the like, and $R^{11}$ is a substituted or unsubstituted alkyl group containing from 1–30 carbon atoms or a substituted or unsubstituted aryl group containing from 6–30 carbon atoms and preferably is a methyl group. Typical useful compounds within this formula are:

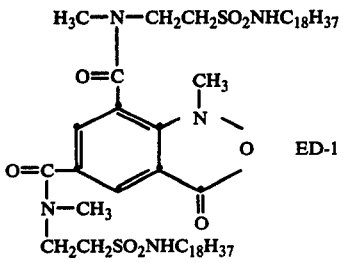

ED-1

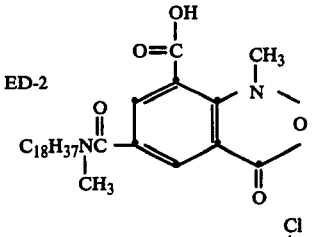

ED-2

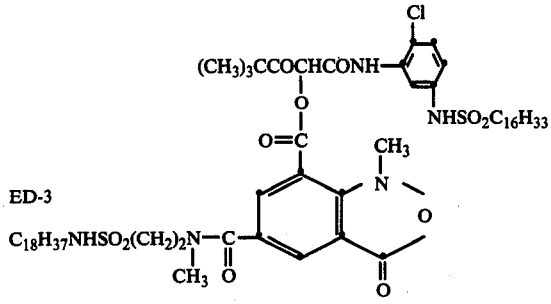

ED-3

-continued

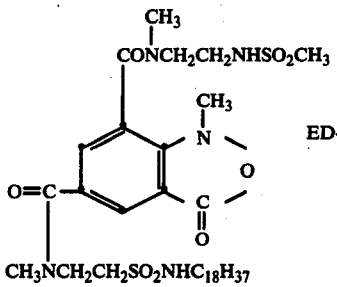

ED-4

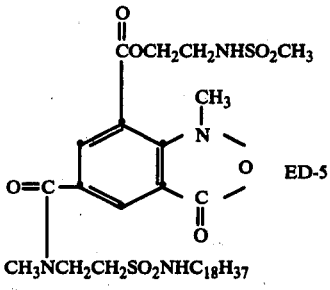

ED-5

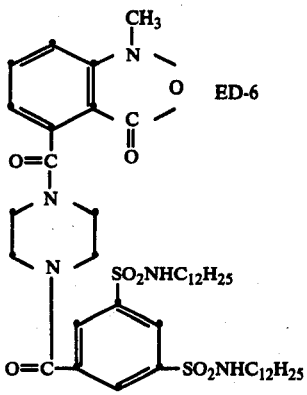

ED-6

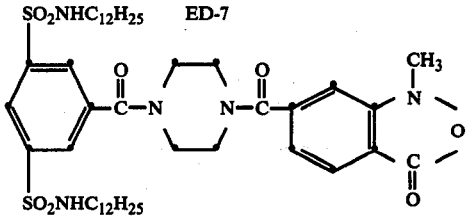

ED-7

In other embodiments, other hydrolyzable electron donors can be used, such as:

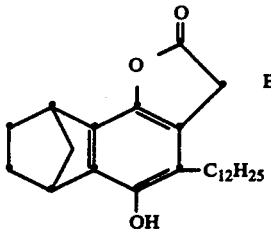
ED-8
Q
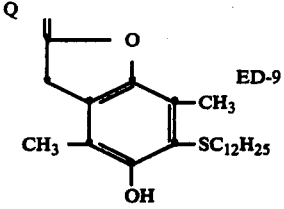
ED-9
ED-10
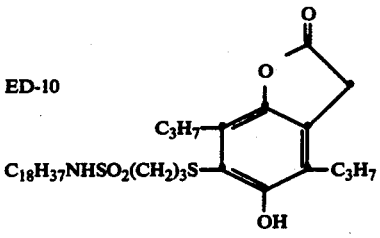
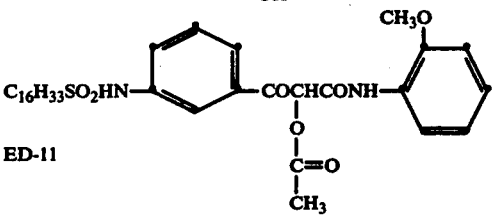
ED-11
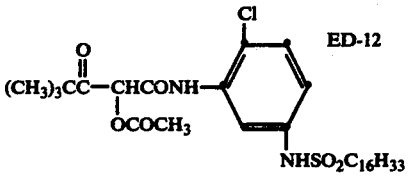
ED-12
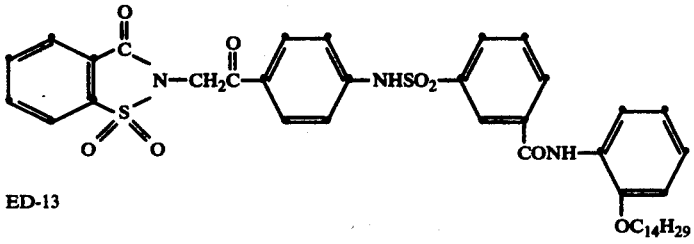
ED-13
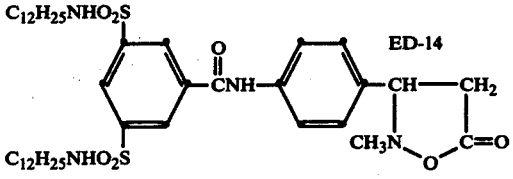
ED-14
In still other embodiments, the electron donor can be present in the keto form, such as in a protohydroquinone, which enolizes in base to form an electron donor. A compound of this type is as follows:
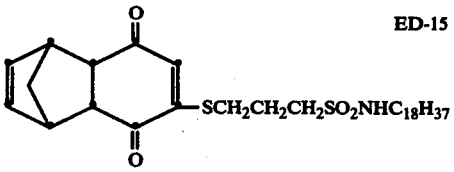
ED-15

In still other embodiments, electron donors can be used which are not precursors, but are preferably at least semi-immobile in the layers of the photographic element. Typical compounds of this type are as follows:

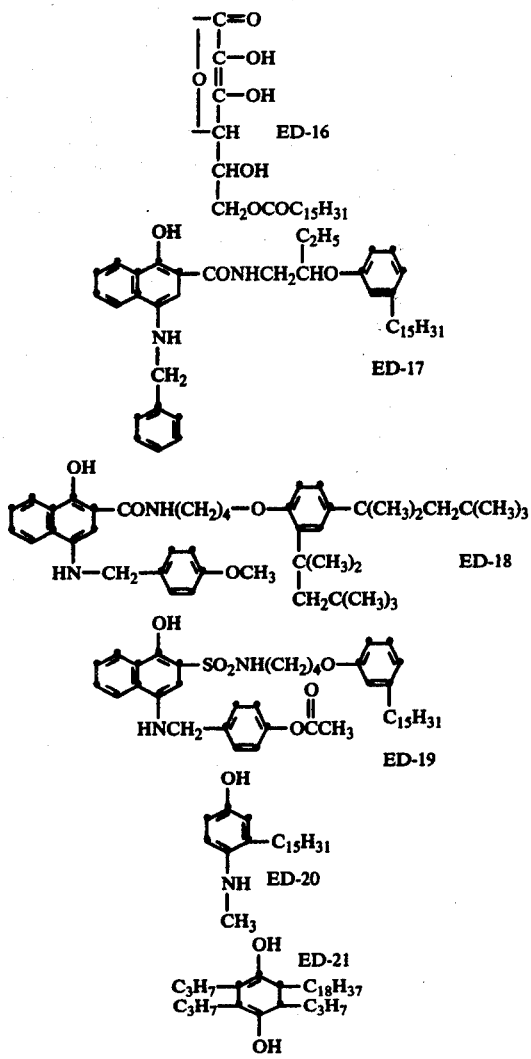

The rates of reaction for the various components can generally be determined by testing the coated ingredients under conditions encountered in the processing of the photographic element, along with some means for identifying the amount of reactant consumed in the reaction. A graph showing the amount of reactant consumed or product produced with respect to time can be used to determine the $t_{\frac{1}{2}}$, $t_{\frac{1}{4}}$, etc., of the reaction.

In one exemplary test for determining the rate of hydrolysis of the electron donor, the following procedure can be used. A photographic element is prepared by coating on a film support, such as a polyethylene terephthalate support, a layer containing gelatin at 2.15 g./m.$^2$, the BEND compound at $3.8 \times 10^{-4}$ moles/m.$^2$ dissolved in diethyl lauramide at equal weight to BEND, negative-working silver bromide emulsion at 1.08 g./m.$^2$ based on silver, and the test electron donor at $7.6 \times 10^{-4}$ moles/m.$^2$ dissolved in diethyl lauramide at equal weight, and an overcoat layer containing vinyl sulfone-hardened gelatin at 0.86 g./m.$^2$. Samples of the photographic element are exposed to roomlight for a period long enough only to render all silver halide developable. The respective elements are then laminated against receiver elements which contain a mordant for the diffusible dye released from the BEND compound, after insertion of an aqueous processing composition containing 51 g./liter of KOH, 3 g./liter of 4-methyl-4-hydroxymethyl-1-phenyl-3-pyrazolidone and 51 g./liter of carboxymethylcellulose with a 75 μm gap between the elements. At various times the respective photographic elements are separated from the receiver elements and inserted for 1 minute in a 1% acetic acid stop bath, and after 3 minutes of water wash they are fixed for 1 minute in a solution containing 120 g. of ammonium thiosulfate, 20 g. of potassium metabisulfite and water to 1 liter, then washed and dried. The respective photographic elements are then relaminated against another receiver element of the same composition for 20 minutes after insertion of an aqueous composition containing 51 g./liter KOH and 51 g./liter of carboxymethyl cellulose with a 75 μm gap between elements. The elements are separated, washed and dried and the density is read. A plot of the densities formed on the second receiver vs. time of the first lamination provides a graph of the hydrolysis of electron donor with respect to time because all remaining hydrolyzable electron donor is hydrolyzed in the second lamination. The diffusible moiety on the BEND compound such as a diffusible dye is the assay reagent for the amount of BEND remaining intact after the first lamination.

In an exemplary test, when BEND Compound 7 (see Examples) is used in the element, along with electron donor ED-4, the $t_{\frac{1}{2}}$ is 40 seconds.

An exemplary test to demonstrate the rate of reaction with an electron donor and the BEND compound is as follows: Exposed photographic elements as described next above with the BEND compound at $6.7 \times 10^{-4}$ moles/m.$^2$, and gelatin at 2.68 g./m.$^2$, the test electron donor at $5.4 \times 10^{-4}$ moles/m.$^2$ and vinyl sulfone-hardened overcoat layer at 0.54 g. gelatin/m.$^2$, are treated for 1 minute with a solution containing 120 g. of ammonium thiosulfate, 20 g. of potassium metabisulfite and water to make 1 liter, followed by a water wash and drying. The elements are then laminated with receiver elements as described above after insertion of an aqueous composition containing 51 g./liter of KOH, 51 g./liter of carboxymethylcellulose and 3 g./liter of 4-methyl-4-hydroxymethyl-1-phenyl-3-pyrazolidone at a 75 μm gap between elements. A plot is made of the dye density vs. time of lamination for various samples to obtain the redox $t_{\frac{1}{2}}$ of reaction between BEND and donor. The cleavage of BEND and the diffusion time of dye to the receiver can be neglected where they are known to proceed rapidly. Where a soluble or highly mobile electron donor is being tested, it can be placed in the processing composition at 3 g./liter instead of in the photographic element.

The redox $t_{\frac{1}{2}}$ for various BEND compounds referred to in the examples when run with the electron donors is set forth in Table 1.

Table 1

| BEND Compound No. | Electron Donor No. | Electron Donor Class | Reaction Rate ($t_{\frac{1}{2}}$ in min.) |
|---|---|---|---|
| 7 | 21 | hydroquinone | 2½ |
| 7 | 15 | protp-hydroquinone | 3 |
| 7 | 8 | lactone | 10 |
| 7 | 9 | lactone | 2 |
| 7 | 10 | lactone | 3½ |

Table 1-continued

| BEND Compound No. | Electron Donor No. | Electron Donor Class | Reaction Rate ($t_{\frac{1}{2}}$ in min.) |
|---|---|---|---|
| 7 | 12 | α-hydroxyketone | 1 |
| 7 | 11 | α-hydroxyketone | 1¾ |
| 7 | 17 | sulfonamidonaphthol | 1 |
| 7 | 18 | p-aminonaphthol | 1 |
| 7 | 19 | p-aminonaphthol | 5 |
| 7 | 20 | p-aminophenol | 3 |
| 7 | 3 | hybrid* | 1½ |
| 7 | 14 | isoxazolone | 2 |

*benzisoxazolone and α-hydroxyketone

In an exemplary test where the soluble electron donor methyltrihydroxypyrimidine is used in combination with BEND Compound 7, the redox $t_{\frac{1}{2}}$ is about 40 seconds.

In an exemplary test where the rate of reaction between an electron-transfer agent and a BEND compound is being determined, the same procedure can be followed as for the soluble electron donors. In tests where 3-pyrazolidones are used, they all have a redox $t_{\frac{1}{2}}$ with BEND of greater than 1 hour.

In tests where BEND Compound 7 is used in combination with the ETA, 4-methyl-4-hydroxymethyl-1-phenyl-3-pyrazolidone, the redox $t_{\frac{1}{2}}$ is greater than 2 hours.

In certain preferred embodiments, the electron donors have a polarographic potential measured in a 0.1 N NaOH solution which is more negative than −200 m.v. with respect to a saturated calomel electrode. Generally, electron donors such as the ascorbic acid electron donors will have a potential of around −250 m.v. and the electron donors such as the useful benzisoxazolone electron donors will have a potential of around −400 m.v.. Because many of the electron donors are ballasted and would be quite insoluble in water, a 50–50 mixture of tetrahydrofuran and 0.2 normal NaOH in water is used for determination. The reference electrode is a saturated calomel electrode and the indicating electrode is a hanging mercury drop electrode. Generally, a concentration of about $2 \times 10^{-4}$ mole/liter of the compound to be tested is used during the test. Where the electron donor is soluble in aqueous alkaline solution, however, the use of organic solvents is not essential during the test.

Where electron donors are used in combination with electron-transfer agents, the polarographic potential of the electron donor will preferably be more negative than the polarographic potential of the electron-transfer agent with reference to the saturated calomel electrode. In highly preferred embodiments, the electron donor is at least 200 m.v. more negative than the electron-transfer agent. In certain preferred embodiments, the electron-transfer agent has a polarographic potential more positive than −200 m.v., such as the 3-pyrazolidone compounds, and the electron donors have a polarographic potential more negative than −200 m.v., such as the benzisoxazolone compounds.

In certain preferred embodiments, the BEND compounds of this invention comprise a diffusible moiety which is a dye-providing material. Preferably, the dye-providing moiety is a preformed dye or a shifted dye. Dye materials of this type are well-known in the art and include dyes such as azo dyes including metalizable azo dyes and metalized azo dyes, azomethine (imine) dyes, anthraquinone dyes, alizarin dyes, merocyanine dyes, quinoline dyes, cyanine dyes and the like. The shifted dyes include those compounds wherein the light absorption characteristics are shifted hypsochromically or bathochromically when subjected to a different environment such as a change in pH, reaction with a material to form a complex such as with a metal ion, removal of a group such as a hydrolyzable acyl group connected to an atom of the chromophore as mentioned by Weyerts, U.S. Pat. No. 3,260,597 issued July 12, 1966, and the like. In certain embodiments, the shifted dyes are highly preferred and especially those containing a hydrolyzable group on an atom affecting the chromophore resonance structure, because the compounds can be incorporated directly in a silver halide emulsion layer or even on the exposure side thereof without substantial reduction in the recording light exposure. During processing after exposure, the dye can be shifted to the appropriate color such as, for example, by hydrolytic removal of the acyl group to provide the respective image dye.

In another embodiment, the BEND compounds of this invention contain a moiety which is an image-dye precursor. The term "image-dye precursor" is understood to refer to those compounds that undergo reactions encountered in a photographic imaging system to produce an image dye, such as color couplers, oxichromic compounds, and the like.

When color couplers are present in the compounds of this invention, the coupler can be released in areas where no development occurs and can diffuse to an adjacent layer where they can be reacted with an oxidized color developer such as a primary aromatic amine to form the image dye. Generally, the color coupler and the color developer are so chosen that the reaction product is immobile. Typical useful color couplers include the pyrazolone couplers, pyrazolotriazole couplers, open-chain ketomethylene couplers, phenolic couplers and the like. Further reference to the description of appropriate couplers is found in U.S. Pat. No. 3,620,747 by Marchant issued Nov. 16, 1971, which is incorporated herein by reference.

The compounds of this invention containing oxichromic moieties can also be advantageously used in a photographic system because they are generally colorless materials due to the absence of an image-dye chromophore. Thus, they can also be used directly in the photographic emulsion or on the exposure side thereof without competitive absorption. Compounds of this type are those compounds which undergo chromogenic oxidation to form the respective image dye. The oxidation can be carried out by subsequent aerial oxidation or incorporation of oxidants into the receiver layers of the film unit. Compounds of this type have been referred to in the art as leuco compounds, i.e., compounds which have no color. Typical useful oxichromic compounds include leuco indoanilines, leuco indophenols, leuco anthraquinones and the like. In certain preferred embodiments, the compounds of this invention contain oxichromic moieties as described by Lestina and Bush in U.S. Pat. No. 3,880,658, which is incorporated herein by reference.

In certain preferred embodiments where the diffusible moiety of the BEND compound is an image dye-providing moiety, the photographic elements of this invention comprise a support having thereon image dye-providing layer units. A multicolor photographic element comprises at least two of said image dye-providing layer units, each of which records light primarily in different regions of the light spectrum. The layer unit comprises a light-sensitive silver salt, which is generally spectrally sensitized to a specific region of the light spectrum, and has associated therewith a photographic color coupler. In certain preferred embodiments, the color-providing layer units are continuous layers which are effectively isolated from other layer units by barrier layers, spacer layers, layers containing scavengers for oxidized developer and the like to prevent any substantial color contamination between the image dye-providing layer units. In other embodiments, the layer units are discontinuous layers comprising mixed packets which are effectively isolated from each other, as disclosed by Godowsky, U.S. Pat. No. 2,698,794 issued Jan. 4, 1954. The effective isolation of the layer units is known in the art and is utilized to prevent contamination in many commercial color products.

The BEND compounds described herein have particular application in a diffusion transfer process where it is desired to have a dye entity transferred to an adjacent layer or a receiving element. However, in certain embodiments this invention relates to the release of an imagewise distribution of a diffusible photographically useful compound which is a photographic reagent. Typical useful photographic reagents are known in the art, such as in U.S. Pat. Nos. 3,227,551, 3,698,898, 3,379,529 and 3,364,022, for example, a silver complexing agent, a silver halide solvent, a fixing agent, a toner, a hardener, an antifoggant, a fogging agent, a sensitizer, a desensitizer, a developer or an oxidizing agent. In other words, $X^1$, —Q—$X^2$ and —Q—$R^9$—$X^3$ in the above formula may represent any moiety which, in combination with a hydrogen atom, provides a photographic reagent upon cleavage.

The diffusible moiety represented by (—Q—$X^2$), $X^1$ or (—Q—$R^9$—$X^3$) in the above formulae can be a silver halide development inhibitor including triazoles and tetrazoles such as a 5-mercapto-1-phenyltetrazole, a 5-methylbenzotriazole, a 5,6-dichlorobenzotriazole and the like, and it can also be an antifoggant including azaindenes such as a tetrazaindene and the like. The compounds that contain releasable silver halide development inhibitors or antifoggants can generally be used in the photographic elements in association with silver halide layers wherein said compound can be incorporated in amounts such as 0.01 to 1 g./m.$^2$ dissolved in a coupler solvent such as diethyl lauramide. When these compounds are incorporated in photographic elements in association with negative silver halide emulsions, a positive imagewise distribution of inhibitor or antifoggant will be produced upon development. Thus, silver development is inhibited or restrained in the low-exposure toe as seen on the D/log E sensitometric curve, but not in the more fully exposed shoulder. Development inhibition of fog of the unexposed areas is thereby achieved selectively. When the silver halide emulsions also have dye releasers in accordance with this invention associated therewith, the overall effect of the inhibitor or antifoggant is to release more dye in the unexposed regions, improving maximum image dye density in the image-receiving layer without increasing the amount of dye released in the exposed regions.

Typical useful BEND compounds containing a photographic reagent are as follows:

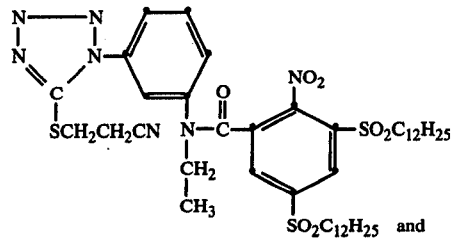

and

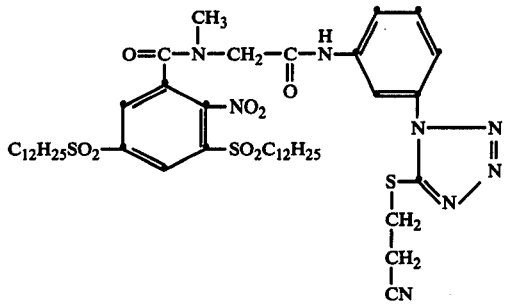

The diffusible moiety represented by Q—$X^2$, $X^1$ or Q—$R^9$—$X^3$ can also be a silver halide development accelerator such as a benzyl alcohol, a benzyl α-picolinium bromide and the like, a fogging agent or nucleating agent, or an auxiliary developer such as a 1-phenyl-3-pyrazolidone, and the like. When these compounds are used in photographic elements in association with silver halide emulsions which also have associated therewith image dye-providing materials in accordance with this invention, the released dye density of all dyes in the unexposed regions would be somewhat reduced by fog development. If, however, one layer was unexposed while the other two were given an imagewise exposure, the amount of nucleating agent or development accelerator reaching the unexposed layer from the other two layers would be less where those layers were exposed. Hence, the Dmax of the unexposed layer would increase as a function of exposure of the other two layers. This greatly enhances the saturation of single colors in a photograph. Where the diffusible moiety affects the electron acceptance or nucleophilic displacement of the BEND compound, it may be desirable to use a derivatized inactive form of the diffusible moiety.

The compounds of this invention are particularly useful in photographic elements and in photographic processes to provide an imagewise distribution of a photographically useful compound. The photographic element can contain the immobile compounds in association with any photographic material that produces an imagewise distribution of electron donor during development which in turn can react with the nucleophilic precursor group on said BEND compound. In certain preferred embodiments, where silver halide emulsions are used as the recording means, the emulsion can be a negative, a direct-positive or a reversal emulsion or the like which undergo development with a silver halide developing agent to produce oxidized silver halide developer. The unexhausted silver halide developing agent can react with the nucleophilic precursor group by a simple redox reaction or electron transfer to provide the nucleophilic group on said BEND compound, whereby intramolecular nucleophilic displacement of the diffusible compound can take place.

Black-and-white or one-color systems can be made that employ as few as one silver halide emulsion and compounds according to this invention that comprise the required image dye-providing moieties to provide the desired net color affect. Preferably, the compounds of this invention are used in three-color systems such as, for example, photographic elements containing a layer comprising a red-sensitive silver halide emulsion having associated therewith a BEND compound comprising a cyan image dye-providing moiety, a layer containing a green-sensitive silver halide emulsion having associated therewith a BEND compound that comprises a magenta image dye-providing moiety, and a layer containing a blue-sensitive silver halide emulsion having associated therewith a BEND compound that comprises a yellow image dye-providing moiety.

In those embodiments of this invention where the BEND compounds contain an image dye-providing moiety, they are generally used in a layer on a support in sufficient quantity to produce a discernible image record. The concentration needed will depend on the thickness of the layer and absorption characteristics of the dye. However, where a visible image record is desired, the BEND compound is generally used in concentrations of at least $1 \times 10^{-5}$ moles/m.$^2$ and preferably from about $1 \times 10^{-4}$ to $2 \times 10^{-3}$ moles/m.$^2$.

The photographic element can be designed to provide an image record in either the image dye-providing material released and made diffusible or the immobile dye remaining in the initial location attached to the oxidized compound and associated with the respective photographic recording material or, in certain instances, both image records can be used. The residual nondiffusible dye can provide an image record which will be present as a function of silver halide development. The silver and silver halide remaining after development can be removed, if desired, to provide better color properties in the record.

In certain preferred embodiments, the photographic element is used in an image-transfer film unit where the dye image-providing material upon release diffuses to an adjacent image-receiving layer. The compounds of this invention can generally be used in any image-transfer unit format designed for image dye-providing materials, because the initially immobile BEND compounds generally function to release the dye independent of the format in which they are used. Typical useful image-transfer formats are disclosed in U.S. Pat. Nos. 2,543,181, 2,627,459, 2,661,293, 2,774,668, 2,983,606, 3,227,550, 3,227,552, 3,309,201, 3,415,644, 3,415,645, 3,415,646 and 3,635,707, Canadian Pat. No. 674,082, Belgian Pat. Nos. 757,959 and 757,960, both issued Apr. 23, 1971, and the like. However, the appropriate silver halide emulsions will have to be used in each format because the present compounds yield a positive image in diffusible dye with a negative recording and developing emulsion.

In preferred embodiments of this invention, the photographic element or film unit contains a compound in addition to said immobile compounds, which is an antifoggant or development restrainer that substantially prevents any further development of a silver halide emulsion after the initial imagewise development has occurred. Generally, the compound is one, that will at least prevent fog buildup in a silver halide layer during the time necessary to release a substantial amount of the photographically useful group from the compound. Typical useful development restrainer precursors that can be used to permit initial development but restrain development thereafter are disclosed in U.S. Pat. Nos. 3,260,597 by Weyerts and 4,009,029 by Hammond et al issued Feb. 22, 1977, and the like. Conventional development restrainers can also be used in the photographic elements or film units wherein they are located in the processing composition, in layers adjacent the silver halide emulsion layers, in the receiving element, in a cover sheet, etc., where contact with the silver halide emulsion is delayed until after the initial image-recording development has occurred.

In a photographic element according to the invention, each silver halide emulsion layer containing an image dye-providing material or having the image dye-providing material present in a contiguous layer may be separated from the other silver halide emulsion layers in the negative portion of the film unit by materials in addition to those described above, including gelatin, calcium alginate, or any of those disclosed in U.S. Pat. No. 3,384,483, polymeric materials such as polyvinylamides as disclosed in U.S. Pat. No. 3,421,892, or any of those disclosed in French Pat. No. 2,028,236 or U.S. Pat. Nos. 2,992,104, 3,043,692, 3,044,873, 3,061,428, 3,069,263, 3,069,264, 3,121,011 and 3,427,158.

In certain preferred embodiments, the multicolor photographic elements of this invention contain interlayers containing antistain agents or oxidized developer scavengers, which interlayers are located between the respective color image-recording layers. Typical antistain agents or oxidized developer scavengers that aid in obtaining improved color separation are disclosed in U.S. Pat. Nos. 2,701,187, 3,700,453, 2,728,659, etc. The layers useful as interlayers between image-recording layers may also be located between the image-receiving layer and the nearest image-recording layer.

Generally, except where noted otherwise, the silver halide emulsion layers in the invention comprise photographic silver halide dispersed in gelatin and are about 0.6 to 6 microns in thickness; the image dye-providing materials are dispersed in an aqueous alkaline solution-permeable polymeric binder, such as gelatin, in the same layer as the silver halide emulsion or as a separate layer about 1–7 microns in thickness; and the alkaline solution-permeable polymeric interlayers, e.g., gelatin, are about 1–5 microns in thickness. Of course, these thicknesses are approximate only and can be modified according to the product desired. In addition to gelatin, other suitable hydrophilic materials include both naturally occurring substances such as proteins, cellulose derivatives, polysaccharides such as dextran, gum arabic and the like; and synthetic polymeric substances such as water-soluble polyvinyl compounds like poly(vinylpyrrolidone), acrylamide polymers and the like.

The photographic emulsion layers and other layers of a photographic element employed in the practice of this invention can also contain, alone or in combination with hydrophilic, water-permeable colloids, other synthetic polymeric compounds such as dispersed vinyl compounds such as in latex form, and particularly those that increase the dimensional stability of the photographic materials. Suitable synthetic polymers include those described, for example, in U.S. Pat. Nos. 3,142,568 by Nottorf issued July 28, 1964, 3,193,386 by White issued July 6, 1965, 3,062,674 by Houck et al issued Nov. 6, 1962, 3,220,844 by Houck et al issued Nov. 30, 1965, 3,287,289 by Ream et al issued Nov. 22, 1966, and 3,411,911 by Dykstra issued Nov. 19, 1968. Particularly effective are water-insoluble polymers of alkyl acrylates and methacrylates, acrylic acid, sulfoalkyl acrylates or methacrylates, those that have crosslinking sites that facilitate hardening or curing, and those having recurring sulfobetaine units as described by Dykstra, Canadian Pat. No. 774,054. In certain instances, it is desirable to use hydrophilic colloid layers which change in permeability to the diffusible materials as a direct function of the pH of the system. Most polymers having acid groups demonostrate a change in permeability with pH and polymers of this type are particularly useful to reduce diffusion between any two layers of the element after processing and neutralization of the element.

Any material can be employed as the image-receiving layer in the film units of this invention as long as the desired function of mordanting or otherwise fixing the image dyes will be obtained. The particular material chosen will, of course, depend upon the due image to be mordanted as mentioned hereinbefore.

Use of a pH-lowering layer in the film units of the invention will usually increase the stability of the transferred image. Generally, the pH-lowering layer will effect a reduction in the pH of the image layer from about 13 or 14 to at least 11 and preferably 5–9 within a short time after imbibition. For example, acids as disclosed in U.S. Pat. Nos. 3,362,819 issued Jan. 9, 1968, 2,584,030 issued Jan. 29, 1952, or 2,548,575 issued Apr. 10, 1951, Belgian Pat. No. 603,747 issued May 31, 1961, p. 47, *Research Disclosure,* vol. 135, 13525, July 19, 1975, and the like, may be employed. Such acids reduce the pH of the film unit after development to terminate development and substantially reduce further dye transfer and thus stabilize the dye image. In certain embodiments, the acids comprise polymers containing acid groups, such as carboxylic acid and sulfonic acid groups, which are capable of forming salts with alkali metals, such as sodium or potassium, or with organic bases, particularly quaternary ammonium bases, such as tetramethyl ammonium hydroxide. The polymers can also contain potentially acid-yielding groups such as anhydrides or lactones or other groups that are capable of reacting with bases to capture and retain them. Generally, the most useful polymeric acids contain free carboxyl groups, being insoluble in water in the free acid form and that form water-soluble sodium and/or potassium salts. Examples of such polymeric acids include dibasic acid half-ester derivatives of cellulose, which derivatives contain free carboxyl groups, e.g., cellulose acetate hydrogen phthalate, cellulose acetate hydrogen gluturate, cellulose acetate hydrogen succinate, ethyl cellulose hydrogen succinate, ethyl cellulose acetate hydrogen succinate, cellulose acetate succinate hydrogen phthalate; ether and ester derivatives of cellulose modified with sulfoanhydrides, e.g., with orthosulfobenzoic anhydride; polystyrene sulfonic acid; carboxymethyl cellulose; polyvinyl hydrogen phthalate; polyvinyl acetate hydrogen phthalate; polyacrylic acid; acetals of polyvinyl alcohol with carboxy or sulfo-substituted aldehydes, e.g., o-, m- or p-benzaldehyde sulfonic acid or carboxylic acid; partial esters of ethylene/-maleic anhydride copolymers; partial esters of methyl vinyl ether/maleic anhydride copolymers; etc. In addition, solid monomeric acid materials could also be used such as palmitic acid, oxalic acid, sebacic acid, hydrocinnamic acid, metanilic acid, paratoluenesulfonic acid and benzenedisulfonic acid. Other suitable materials are disclosed in U.S. Pat. Nos. 3,422,075 and 2,635,048 and *Research Disclosure,* vol. 123, No. 12331, July, 1974.

The pH-lowering layer is usually about 0.3 to about 1.5 mils in thickness and can be located in the receiver portion of the film unit between the support and the image-receiving layer, on the cover sheet, or anywhere within the film unit as long as the desired function is obtained.

An inert timing or spacer layer coated over the pH-lowering layer may also be used to "time" or control the pH reduction of the film unit as a function of the rate at which the alkali diffuses through the inert spacer layer. Examples of such timing layers include gelatin, polyvinyl alcohol or any of those disclosed in U.S. Pat. No. 3,455,686. The timing layer is also effective in evening out the various reaction rates over a wide range of temperatures, e.g., premature pH reduction is prevented when imbibition is effected at temperatures above room temperature, for example, at 95° to 100° F. The timing layer is usually about 0.1 to about 0.7 mil in thickness. Especially good results are obtained when the timing layer comprises a hydrolyzable polymer or a mixture of such polymers which are slowly hydrolyzed by the processing composition. Examples of such hydrolyzable polymers include polyvinyl acetate, polyamides, cellulose esters, etc. The neutralizing material can also be dispersed in the timing layer where reduction in pH is achieved as the neutralizing material becomes available to the processing composition. Where the acid is incorporated into the film unit in a form which is not readily available, it is also possible to achieve the predetermined highly alkaline processing time without separate timing layers because said material is inherently slow in reducing the pH. Timing layers can also be used effectively to isolate development restrainers in a layer adjacent the image-receiving layer or other layers on the photographic element, wherein restrainers will be released after alkali breakdown of the timing layer.

The alkaline processing composition employed in this invention can be conventional aqueous solutions of an alkaline material, e.g., sodium hydroxide, sodium carbonate or an amine such as diethylamine, preferably possessing a pH in excess of 12, and preferably contains a developing agent as described previously. The solution also preferably contains a viscosity-increasing compound such as a high-molecular-weight polymer, e.g., a water-soluble ether inert to alkaline solutions such as hydroxyethyl cellulose or alkali metal salts of carboxymethyl cellulose such as sodium carboxymethyl cellulose. A concentration of viscosity-increasing compound of about 1 to about 5% by weight of the processing solution is preferred that will impart thereto a viscosity of about 100 cps. to about 200,000 cps.

The alkaline processing composition employed in this invention can also contain a desensitizing agent such as methylene blue, nitro-substituted heterocyclic compounds, 4,4'-bipyridinium salts, etc., to insure that the photosensitive element is not further exposed after it is removed from the camera for processing.

While the alkaline processing composition used in this invention can be employed in a rupturable container, as described previously, to facilitate conveniently the introduction of processing composition into the film unit, other means of discharging processing composition within the film unit could also be employed, e.g., interjecting processing solution with communicating members similar to hypodermic syringes that are attached to either a camera or camera cartridge, as described by Harvey, U.S. Pat. No. 3,352,674 issued Nov. 14, 1967.

In certain embodiments of our invention, and especially with integral format film units, an opacifying agent can be employed in the processing composition in our invention. Examples of opacifying agents include carbon black, barium sulfate, zinc oxide, barium stearate, silver flake, silicates, alumina, zirconium oxide, zirconium acetyl acetate, sodium zirconium sulfate, kaolin, mica, titanium dioxide, organic dyes such as the nigrosines, or mixtures thereof in widely varying amounts depending upon the degree of opacity desired. In general, the concentration of opacifying agent should be sufficient to prevent further exposure of the film unit's silver halide emulsion or emulsions by ambient actinic radiation through the layer of processing composition, either by direct exposure through a support or by light piping from the edge of the element. For example, carbon black will generally provide sufficient opacity when they are present in the processing solution in an amount of from about 5–40% by weight. After the processing solution and opacifying agent have been distributed into the film unit, processing may take place out of the camera in the presence of actinic radiation in view of the fact that the silver halide emulsion or emulsions of the laminate are appropriately protected by incident radiation, at one major surface by the opaque processing composition and at the remaining major surface by an alkaline solution-permeable opaque layer. Opaque binding tapes can also be used to prevent edge leakage of actinic radiation incident on the silver halide emulsion. In certain embodiments, ballasted indicator dyes or dye precursors can be incorporated in a layer on the exposure side of the photosensitive layers; the indicator dye is preferably transparent during exposure and becomes opaque when contacted with the processing composition.

When titanium dioxide or other white pigments are employed as the opacifying agent in the processing composition, it may also be desirable to employ in cooperative relationship therewith a pH-sensitive opacifying dye such as a phthalein dye. Such dyes are light-absorbing or colored at the pH at which image formation is effected and colorless or not light-absorbing at a lower pH.

The alkaline solution-permeable, substantially opaque, light-reflective layer in the integral image-transfer film units of our invention can generally comprise any opacifier dispersed in a binder as long as it has the desired properties. Particularly desirable are white light-reflective layers because they would be esthetically pleasing backgrounds on which to view a transferred dye image and would also possess the optical properties desired for reflection of incident radiation. Suitable opacifying agents include titanium dioxide, barium sulfate, zinc oxide, barium stearate, silver flake, silicates, alumina, zirconium oxide, zirconium acetyl acetate, sodium zirconium sulfate, kaolin, mica, or mixtures thereof in widely varying amounts depending upon the degree of opacity desired. The opacifying agents may be dispersed in any binder such as an alkaline solution-permeable polymeric matrix such as, for example, gelatin, polyvinyl alcohol, and the like. Such an opaque layer would generally have a density of at least 4 and preferably greater than 7 and would be substantially opaque to actinic radiation. The opaque layer may also be combined with a developer scavenger layer if one is present. The light-reflective and opaque layers are generally 1–20 $\mu$m in thickness, although they can be varied depending upon the opacifying agent employed, the degree of opacity desired, etc.

The supports of the film elements of this invention can be any material as long as it does not deleteriously affect the photographic properties of layers thereon and is substantially dimensionally stable. Typical useful supports include cellulose nitrate film, cellulose acetate film, poly(vinyl acetal) film, polystyrene film, poly(ethylene terephthalate) film, polycarbonate film, poly-$\alpha$-olefins such as polyethylene and polypropylene film, and related films or resinous materials, as well as glass. In those embodiments where the support is transparent, it is usually about 20–150 microns in thickness and may contain an ultraviolet absorber, if desired.

The support of the integral imaging receiver film assemblies and the cover sheet used with these assemblies of this invention can be any of the materials mentioned above for the support. If desired, an ultraviolet-absorbing material and a material for preventing light piping can be employed in the support or cover sheet.

The photosensitive substances used in this invention are preferably photographic silver halide compositions which are capable of recording an imagewise exposure of light and can comprise silver chloride, silver bromide, silver bromoiodide, silver chlorobromoiodide and the like, or mixtures thereof. The emulsions may be coarse- or fine-grain and can be prepared by any of the well-known procedures, e.g., single-jet emulsions, double-jet emulsions, such as Lippmann emulsions, ammoniacal emulsions, thiocyanate or thioether ripened emulsions such as those described in U.S. Pat. Nos. 2,222,264 by Nietz et al, 3,320,069 by Illingsworth and 3,271,157 by McBride. Surface-image emulsions can be used or internal-image emulsions can be used such as those described in U.S. Pat. Nos. 2,592,250 by Davey et al, 3,206,313 by Porter et al and 3,447,927 by Bacon et al. The emulsions may be regular-grain emulsions such as the type described by Klein and Moisar, *J. Phot. Sci.*, Vol. 12, No. 5, Sept./Oct., 1964, pp. 242–251. The silver halide emulsions can be spectrally sensitized by means known in the art including techniques of spectrally sensitizing to provide good color balance under various light illumination as described by Schwan et al, U.S. Pat. No. 3,672,898 issued June 27, 1972. The silver halide emulsions made using techniques well-known in the art to achieve high camera speed, such as speeds of from 400 to above 1000, are especially useful in this invention.

Blends of emulsions having different grain sizes and/or sensitivities can be used to control contrast and exposure latitude. Such emulsions can also be coated in separate layers, if desired, with an image dye-providing material in one or more of said emulsions, especially where preformed dyes are used.

Negative-type emulsions can be used or direct-positive emulsions can be used such as those described in U.S. Pat. Nos. 2,184,013 by Leermakers, 2,541,472 by Kendall et al, 3,367,778 by Berriman, 3,501,307 by Illingsworth et al issued Mar. 17, 1970, 1,563,785 by Ives, 2,456,953 by Knott et al, 2,861,885 by Land, 3,761,276 by Evans, 3,761,266 by Milton, 3,761,267 by Gilman et al, 3,736,140 by Collier et al and 3,730,723 by Gilman et al, British Pat. No. 723,019 by Schouwenaars, and U.S. Ser. No. 154,155 by Gilman et al filed June 17, 1971.

In still another embodiment, the BEND compounds can be coated in a layer in an alkali-permeable binder on a support to provide what is often referred to as a receiver element. The receiver element can be processed by several methods including positioning it in interfacial contact with a photographic silver halide element in the presence of an alkaline solution and a silver halide developer. In those areas where an electron donor such as unexhausted silver halide developer diffuses to the receiver layer, the BEND compound will be reduced, and if it contains a dye moiety it will provide a permanent image dye record in the areas corresponding to the original silver halide development. The remainder of the diffusible dye can be removed from the element, for example, by washing, after intramolecular nucleophilic displacement. With proper selection of the image dye-providing moieties, a black-and-white image can be obtained. Also, if the nucleophilic compound contains a tanning agent as the photographically useful moiety, it is possible to obtain a tanned image record in areas where silver halide development does not take place, i.e., a positive image record if a negative emulsion is used.

The electron donors and BEND compounds can be incorporated in the layers of photographic elements by any means known in the art. Generally, where the electron donors and BEND compounds are incorporated in alkali-permeable hydrophilic colloids, the compounds can be dispersed in any convenient manner, such as using solvents and techniques described in U.S. Pat. Nos. 2,322,027 by Jelley issued June 15, 1943, or 2,801,171 by Fierke et al issued June 30, 1957. When coupler solvents are employed, the most useful range of electron donor or BEND to coupler solvent is from 1:3 to 1:0.1. Preferably, the coupler solvent is a moderately polar solvent. Typical useful solvents include tri-o-cresyl phosphate, di-n-butyl phthalate, diethyl lauramide, 2,4-diamylphenol, liquid dye stabilizers as described in an article entitled "Improved Photographic Dye Image Stabilizer-Solvent," *Product Licensing Index,* Vol. 83, pp. 26–29, March, 1971, and the like. In other embodiments, the electron donor or BEND compound can be dissolved in a water-miscible organic solvent such as tetrahydrofuran, methyl alcohol, ethyl alcohol, isopropyl alcohol, acetone, 2-butanone, N-methylpyrrolidone, dimethylformamide, dimethyl sulfoxide or mixtures thereof, and to this mixture can then be added a suitable loadable polymeric latex of the type disclosed by Chen, German OLS No. 2,541,274, where the compounds are distributed on the latex particles.

Generally, the photographic elements and film units containing BEND compounds in accordance with this invention can incorporate those features known in the art such as disclosed in *Research Disclosure,* November, 1976, No. 151, Item 15162, pp. 75–87.

In this application, certain groups are identified with reference to the periodic table. The reference table is located on pp. 400–401 of the *Handbook of Chemistry and Physics,* 39th Ed., Chemical Rubber Publishing Co.

The photographic elements, as described above, generally comprise at least one layer containing photographic recording material, such as silver halide, having associated therewith an immobile compound. The term "associated therewith" is a term of art in the photographic industry and generally refers to said immobile compound in alkaline-permeable relationship with said photographic recording material. The respective materials can be coated in the same layers or separate layers, as long as they are effectively associated and isolated to provide for the desired reactions before a substantial amount of the intermediate reactant products diffuse into adjacent photographic recording layers, etc.

The photographic elements in the above tests, as well as in the following examples, can contain the normal coating addenda such as surfactants, hardeners, sensitizers, melt stability adjuvants and the like which are used in making photographic elements. Where hardened overcoat layers are specified, hardening of the layers of the element is obtained by adding to said layer about 2% of a hardener, such as a vinyl sulfone, based on the total weight of the hardenable vehicle in the element.

The invention is further illustrated by the following examples.

EXAMPLE 1

One-color Element with Quinone-type BEND Compound and Incorporated Electron-donor Agent A photographic image-transfer-type film unit is prepared by coating layers as follows:

Layer 1 — a polyethylene terephthalate film support;
Layer 2 — a negative-type silver bromide emulsion (0.8μ ) at 1.08 g. Ag/m.$^2$, gelatin at 2.15 g./m.$^2$, BEND Compound I at 0.44 g./m.$^2$, Electron Donor ED-1 at 0.74 g./m.$^2$ and diethyl lauramide at 1.18 g./m.$^2$; and
Layer 3 — hardened gelatin at 0.54 g./m.$^2$.

A sample of the element was exposed through a graduated-density test object and processed by rupturing a pod containing a processing composition comprising 51 g. potassium hydroxide, 20 g. potassium bromide, 0.5 g. 4-methyl-4-hydroxymethyl-1-phenyl-3-pyrazolidone and 40 g. carboxymethyl cellulose per liter of water while in contact with a receiving element containing 2.15 g./m.$^2$ of the mordant poly(divinylbenzene-co-styrene-co-N-benzyl-N,N-dimethyl-N-vinylbenzyl ammonium chloride) and gelatin at 2.15 g./m.$^2$.

After 10 min., the photosensitive element and the receiving element were separated and a well-defined positive magenta dye image (Dmax 1.88, Dmin 0.28) was observed in the receiver.

EXAMPLE 2

Two-color Element with Quinone-type BEND Compound, Incorporated Electron Donor and Oxidant Interlayer A photographic image-transfer-type film unit was prepared by coating layers as follows:

Layer 1 — polyethylene terephthalate film support;
Layer 2 — gelatin at 1.08 g./m.$^2$, BEND Compound 3 at 0.57 g./m.$^2$ and diethyl lauramide at 0.57 g./m.$^2$;
Layer 3 — a negative-type green-sensitive silver bromoiodide emulsion at 1.61 g. Ag./m.$^2$, gelatin at 3.24 g./m.$^2$, Electron Donor ED-16 at 1.94 g./m.$^2$, diethyl lauramide at 1.94 g./m.$^2$ and 4-methyl-4-hydroxymethyl-1-phenyl-3-pyrazolidone at 0.054 g./m.$^2$;
Layer 4 — gelatin at 1.61 g./m.$^2$, 2,4,6-trichloro-3-n-pentadecylquinone oxidant scavenger at 1.08 g./m.$^2$ and 2,4-di-tert-amylphenol at 0.27 g./m.$^2$;
Layer 5 — gelatin at 0.86 g./m.$^2$ and 2,5-di-sec-dodecyl hydroquinone developer scavenger at 0.86 g./m.$^2$;
Layer 6 — gelatin at 2.48 g./m.$^2$, BEND Compound 2 at 0.85 g./m.$^2$, diethyl lauramide at 0.85 g./m.$^2$ and a yellow filter dye at 0.86 g./m.$^2$;
Layer 7 — a negative-type blue-sensitive silver bromoiodide emulsion at 1.61 g. Ag/m.$^2$, gelatin at 3.76 g./m.$^2$, Electron Donor ED-16 at 1.94 g./m.$^2$, diethyl lauramide at 1.94 g./m.$^2$ and 4-methyl-4-hydroxymethyl-1-phenyl-3-pyrazolidone at 0.054 g./m.$^2$; and Layer 8 — hardened gelatin at 0.54 g./m.$^2$.

A sample of the element was selectively exposed through a graduated-density test object with white, green and blue light sources. The exposed sample was processed by rupturing a pod containing a processing composition comprising 20 g. potassium hydroxide, 10 g. potassium bromide and 40 g. carboxymethyl cellulose per liter of water while in contact with a receiver element containing 2.15 g./m.$^2$ of poly(styrene--co-N,N,N-tri-n-hexyl-N-vinylbenzyl ammonium chloride) and 2.15 g./m.$^2$ of gelatin.

After 20 min., the photosensitive element and receiving element were separated and well-defined positive dye images were observed in the receiver. The results are tabulated as follows:

| | Dmax* | | Dmin | |
|---|---|---|---|---|
| Exposure | Blue | Green | Blue | Green |
| neutral | 1.30 | 1.56 | 0.40 | 0.40 |
| green | 1.40 | 1.54 | 1.13 | 0.51 |
| blue | 1.37 | 1.53 | 0.54 | 1.37 |

*Dmax is the maximum dye density of the images transferred from unexposed, undeveloped areas of the photosensitive element.

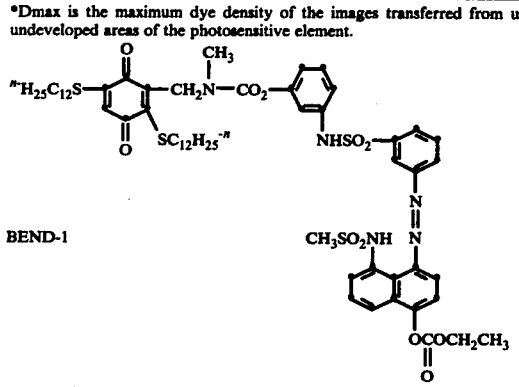

BEND-1

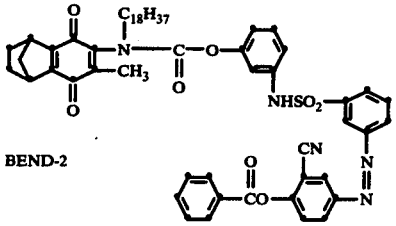

BEND-2

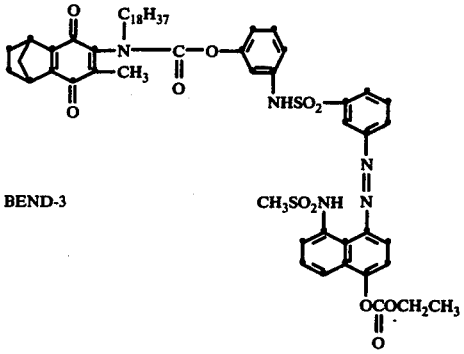

BEND-3 the following BEND compounds which contain two releasable dye moieties on each ballasted quinone can also be used to provide good results in the photographic elements of Examples 1–2.

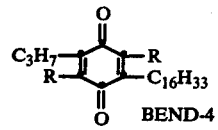

BEND-4

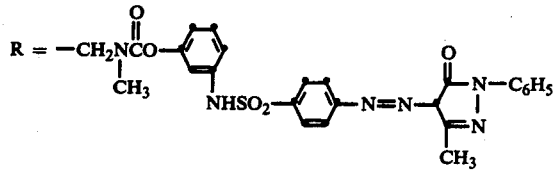

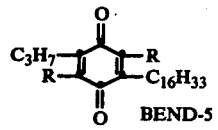

BEND-5

R =

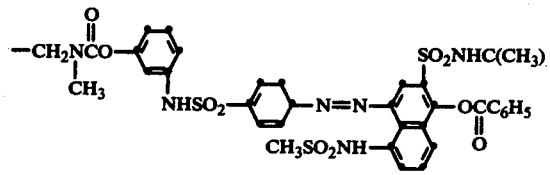

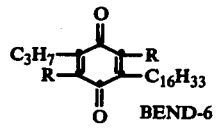

BEND-6

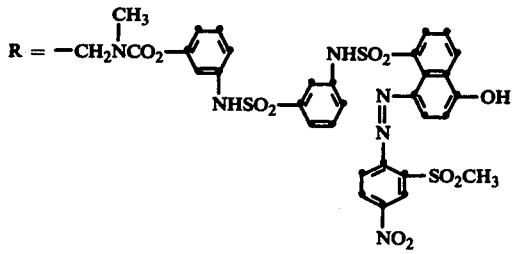

In the synthesis of the compounds in the following examples, the structure was confirmed in each instance by infrared analysis and, in some instances, further verified by nmr and mass spectroscopy analysis. Melting points for the intermediates are specified where they were applicable in further identification of the respective compound.

Example A: BEND-7

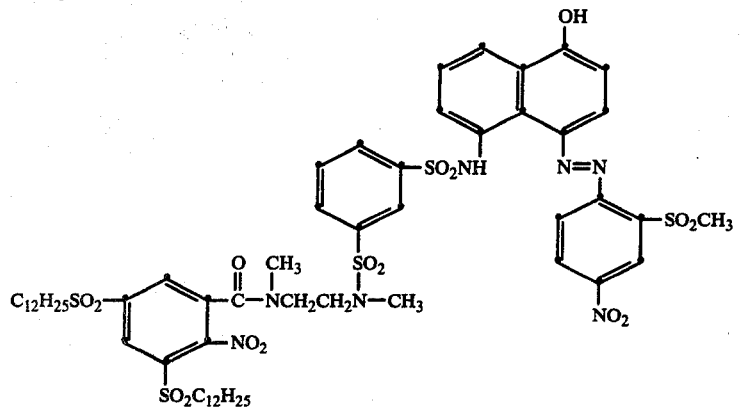

Step 1: 3,5-dichloro-2-nitrobenzoic acid

In a 5-liter, 3-necked flask were placed 2000 ml. of 90% nitric acid. The mixture was stirred and heated to 70° C. The heating mantel was removed and, with continued stirring, 500 g. of solid 3,5-dichlorobenzoic acid was added in portions so as to maintain a reaction temperature of about 70° C. (The addition is only very mildly exothermic so that large portions of the dichloroacid may be added at one time. The total time for addition of the 500 g. was about 20 min.) After the addition, the reaction was stirred and heated at 75°-80° C. for 3 hr. The mixture (containing some solid) was then cooled, finally in ice. The solid was collected on a sintered glass funnel and washed with cold water (3 × 500 ml.) and dried. Yield 555.3 g. (90%); m.p. 190°-192° C.

Step 2: 3,5-didodecylthio-2-nitrobenzoic acid

An amount of 236 g. (1 mole) 3,5-dichloro-2-nitrobenzoic acid (Step 1) and 424 g. (2.1 moles) 1-dodecanethiol in 1.5 liter ethanol and 1 liter water was purged with nitrogen for 15-30 min. Then 430 g. (3.1 moles) anhydrous potassium carbonate were added and the reaction mixture was refluxed under an atmosphere of nitrogen for 60-72 hr. After cooling to room temperature, the solution was poured slowly into a rapidly stirred mixture of 6 liters water, 360 ml. conc. HCl and crushed ice. The precipitated solid was collected and washed well with water. The yellow material was slurried in 2.7 liters of glacial acetic acid, filtered, washed with a small amount of glacial acetic acid and dried in vacuo at 45° C. An amount of 560 g. of the product was obtained, m.p. 74°-77° C.

Step 3: 3,5-didodecylsulfonyl-2-nitrobenzoic acid

To a stirred slurry of 320 g. (0.56 mole) 3,5-didodecylthio-2-nitrobenzoic acid (Step 2) and 0.6 g. (0.002 mole) (ethylenedinitrilo)tetraacetic acid in 2.6 liters glacial acetic acid were added 330 ml. of 30% hydrogen peroxide. The mixture was heated gradually to 75° C. when a mild exotherm (to about 90° C.) began. Heating was stopped until the exotherm subsided. Then the run was heated at 80° C. until a negative or very weak test for peroxide was obtained with starch-iodide paper. At this point, 70 ml. of 30% hydrogen peroxide were added all at once and heating at 80° C. was resumed for about 15 hr. Cooling crystallized the desired white crystals which were collected and washed in sequence with cold glacial acetic acid and then water. On drying, 340 g. of product were obtained, m.p. 153°-154.5° C.

Step 4: 3,5-didodecylsulfonyl-2-nitrobenzoyl chloride

Oxalyl chloride (2 ml., 0.16 mole), followed by 2 drops of N,N-dimethylformamide (DMF), was added to a slurry of 6.32 g. (0.01 mole) 3,5-didodecylsulfonyl-2-nitrobenzoic acid (Step 3) in 50 ml. benzene. When the initial rapid evolution of gas had subsided, 6 drops of DMF were added in two portions. After 1 hr., an additional 1 ml. of oxalyl chloride was added. The reaction mixture was concentrated to a yellow paste and then was titurated with about 50 ml. cold acetonitrile. The mixture was filtered and washed with fresh acetonitrile to give a white solid. After drying in a vacuum oven, 4.81 g. (74% yield) of the desired acid chloride were obtained.

Step 5: BEND-7

A solution of 5.2 g. (0.008 mole) of acid chloride (Step 4 above) in 30 ml. tetrahydrofuran (THF) was added dropwise to a stirred solution of 5.7 g. (0.008 mole) of 5-{3-[N-(methylaminoethyl)-N-methylsulfamoyl]phenylsulfonamido}-4-(2-methylsulfonyl-4-nitrophenylazo)-1-naphthol hydrochloride (dye fragment A) in 50 ml. DMF containing 1.7 g. (0.0176 mole) triethylamine. After the addition, most of the THF was removed under vacuum. The remaining solution was poured slowly with rapid stirring into 250 ml. ice-cold water. The deep blue-black solid was collected and washed in sequence with water, dilute (0.01 N) HCl, and then water. The washed material was dried, dissolved in THF and added to a 2-inch-by-8-inch column filled with 100-200 mesh Florisil (activated magnesium silicate). The product was eluted with 1500 ml. THF. The eluate was concentrated to dryness. The residue was dissolved in a minimum of dichloromethane and then poured slowly into 150 ml. of ice-cold ligroine (b.p. 35°-60° C.). The solid was collected, washed with ligroine and dried. A yield of 5.6 g. (54% yield) of BEND 7 was obtained.

Example B: BEND-8

-continued

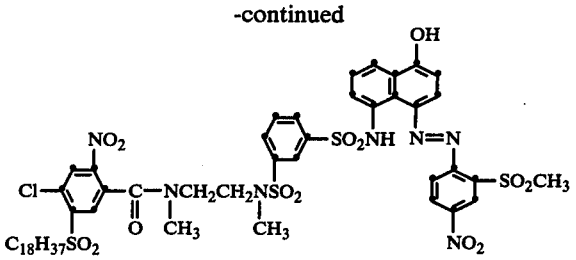

Step 1: 4-chloro-5-octadecylsulfonyl-2-nitrobenzoic acid

This compound was prepared from 4,5-dichloro-2-nitrobenzoic acid in the manner described in Example A, Steps 2 and 3, using one equivalent of octadecanethiol in place of dodecanethiol.

Step 2: 4-chloro-5-octadecylsulfonyl-2-nitrobenzoyl chloride

This compound was prepared from the free acid (Step 1 above) and 16 equivalents of oxalyl chloride according to the procedure of Example A, Step 4.

Step 3: BEND-8

The corresponding dye-containing BEND compound was prepared by following the procedure described in Step 5 of Example A using dye fragment A and 4-chloro-5-octadecylsulfonyl-2-nitrobenzoyl chloride prepared in Step 2 above.

A number of other nitrobenzenoid derivatives and dye fragments were prepared and reacted together to form various other BEND compounds of the invention. Typical reactions and conditions for making these compounds are described in Examples A and B above. The alkylenediamino group linking the dye to the nitrobenzoic acid was supplied either by (1) reacting the corresponding mono-protected diamine with the appropriate ballasted nitrobenzoyl chloride, followed by deprotection of the amine and reaction with a dye fragment bearing a sulfonyl chloride group, or (2) by reacting an excess of a diamine with a dye fragment containing a chlorosulfonyl group and reacting the resulting amine dye with the appropriate ballasted nitrobenzoyl chloride. BEND compounds were prepared using two types of nitro derivatives and the appropriate types of dye fragments as shown in Table 1 below.

Table 1

| Example | Compound | Nitrobenzenoid Derivative | Dye Fragment |
|---|---|---|---|
| C | BEND-9 | 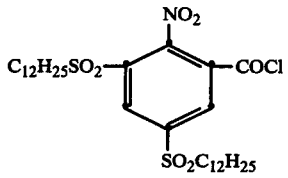 | 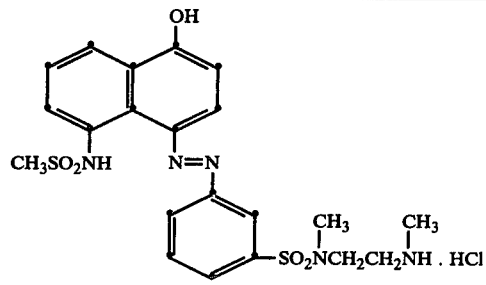 |
| D | BEND-10 | 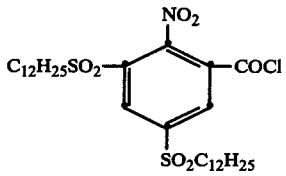 | 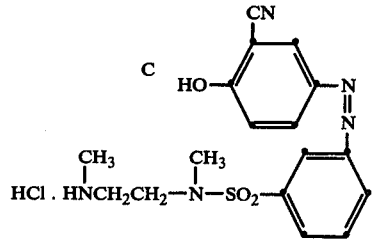 |
| E | BEND-11 | 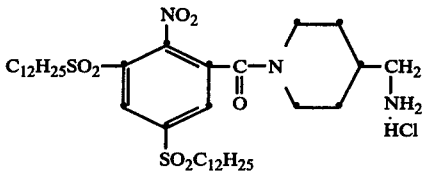 | 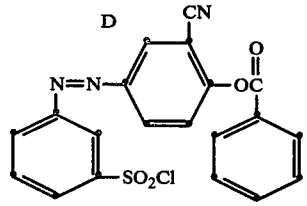 |
| F | BEND-12 | 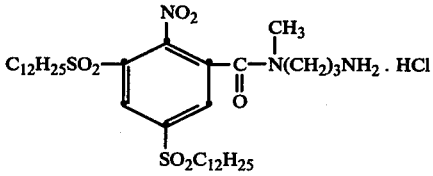 | D |

Table 1-continued

| Example | Compound | Nitrobenzenoid Derivative | Dye Fragment |
|---|---|---|---|
| G | BEND-13 | 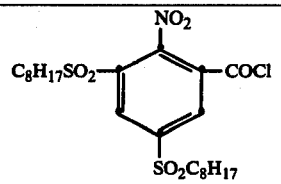 | A (see Step 5 of Example A) |
| H | BEND-14 | same | C |
| I | BEND-15 | 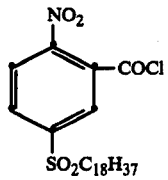 | A |
| J | BEND-16 | 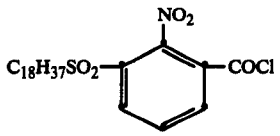 | A |
| K | BEND-17 | 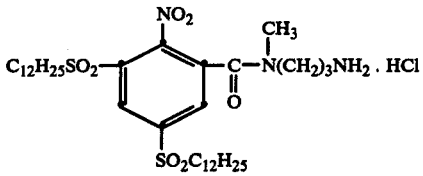 | 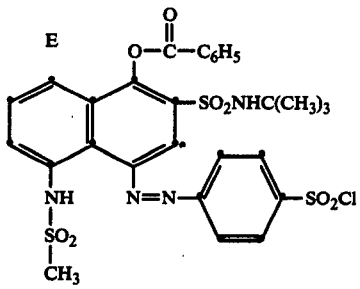 |

Example L: Preparation of BEND-18

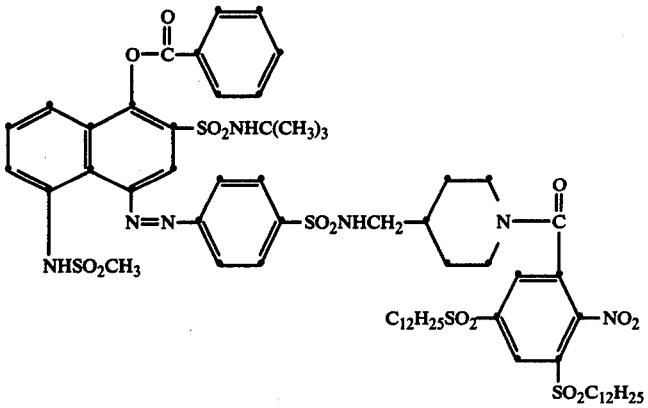

Step 1:
4-aminomethyl-1-(3,5-didodecylsulfonyl-2-nitrobenzoyl)piperidine hydrochloride To 1.14 g. (0.01 mole) of 4-aminomethylpiperidine in 25 ml. benzene were added 1.22 g. (0.01 mole) salicylaldehyde dropwise with stirring. The volume was then reduced to about 10 ml. by distilling off benzene at atmospheric pressure. The concentrated yellow solution was mixed with 30 ml. of tetrahydrofuran (THF) and 1.01 g. (0.01 mole) of triethylamine were added. The mixture was stirred and cooled in a cold-water bath while a solution of 6.5 g. (0.01 mole) of 3,5-didodecylsulfonyl-2-nitrobenzoyl chloride (see Example A) in 40 ml. THF was added dropwise. After the addition, the reaction mixture was stirred for 30 min. at ambient temperature and filtered to remove the by-product, triethylamine hydrochloride. The solid was washed with a small amount of THF and discarded. The combined filtrate-and-THF wash was treated with 4 ml. of 6N HCl and stirred about 15 hr. The resulting gelled solution was boiled to reduce the volume of the acidified filtrate to about 50 ml. At this point, the hot solution was diluted slowly with 75 ml. acetonitrile and rapid stirring. The diluted mixture was stirred at ambient temperature until cool. The white solid was collected on a funnel, washed with cold acetonitrile and dried. The yield of the desired product was 4.69 g. TLC of a sample of the product on silica gel with methanol-acetone (5:20) gave only one spot.

Step 2: BEND-18

With stirring, 15.3 g. of 4-aminomethyl-1-(3,5-didodecylsulfonyl-2-nitrobenzoyl)piperidine hydrochloride were added to 300 ml. THF. After almost all of the hydrochloride had dissolved, 13.6 g. of 4-[4-benzoyloxy-8-methanesulfonamido-3-(N-t-butylsulfamoyl)-1-naphthylazo]benzenesulfonyl chloride were added, followed by dropwise addition of 4.0 g. of triethylamine. The viscosity of the mixture gradually decreased and stirring was continued for 4 hr. at ambient temperature. The run was filtered and the collected solid discarded. The filtrate was chromatographed on 500 g. Florisil, eluting with benzene-ethyl acetate (2:1). Crude product amounting to 18 g. was obtained from the eluate. This material was dissolved in 100 ml. ethyl acetate, filtered, diluted to 450 ml. volume with ether and allowed to stand about 15 hr. The solid that had formed was collected on a funnel, washed with a mixture of ethyl acetate and ether (1:3.5) and dired under vacuum at ambient temperature. The yield of Compound BEND-18 was 13.5 g.

EXAMPLES M-O

The following compounds were prepared using a procedure similar to Example L with the appropriate intermediate materials.

Table 2

| Example | Compound | |
|---|---|---|
| M | BEND-19 | 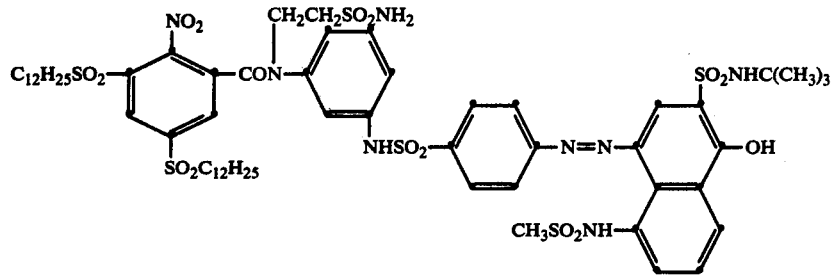 |
| N | BEND-20 | 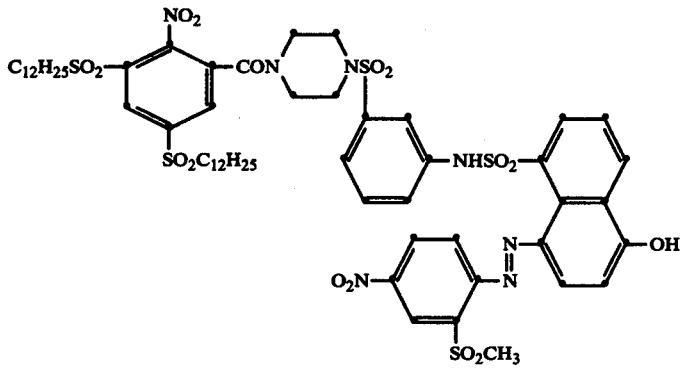 |
| O | BEND-21 | 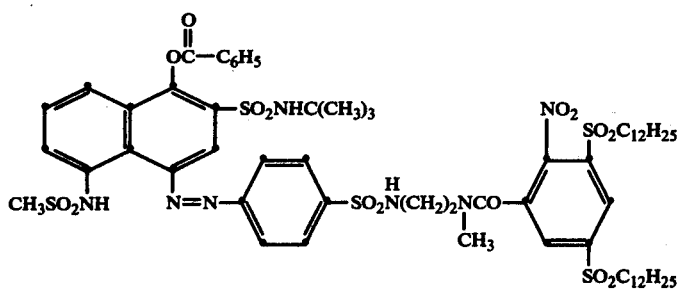 |

EXAMPLE 3

One-Color Element with Nitro-substituted BEND Compound and Incorporated Electron Donor A photographic image-transfer-type film unit was prepared by coating layers as follows:

Layer 1 — polyethylene terephthalate film support;
Layer 2 — a negative-type silver bromide emulsion (0.8 μ) at 1.08 g. Ag/m.$^2$, gelatin at 1.61 g./m.$^2$, BEND-13 at 0.44 g./m.$^2$, diethyl lauramide at 1.18 g./m.$^2$ and Electron Donor ED-1 at 0.74 g./m.$^2$; and
Layer 3 — hardened gelatin at 0.54 g./m.$^2$.

A sample of the element was exposed through a graduated-density test object and processed by rupturing a pod containing a processing composition comprising 85 g. potassium hydroxide, 20 g. potassium bromide, 3 g. 4-methyl-4-hydroxymethyl-1-phenyl-3-pyrazolidone, 1.0 g. 5-methylbenzotriazole and 40 g. carboxymethyl cellulose per liter of water while in contact with a receiving element containing 2.15 g./m.$^2$ of copoly(styrene-co-N,N,N-tri-n-hexyl-N-vinylbenzyl ammonium chloride) and gelatin at 2.15 g./m.$^2$.

After 10 min., the photosensitive element and the receiver were separated and a well-defined positive cyan dye image (Dmax 2.0, Dmin 0.18) was observed in the receiver.

EXAMPLE 4

Another one-color photographic image-transfer-type film unit was prepared like Example 3, except that Electron Donor ED-2 at 0.27 g./m.$^2$ was used in place of Electron Donor ED-1 at 0.74 g./m.$^2$ and the amount of diethyl lauramide was reduced to 0.71 g./m.$^2$ instead of 1.18 g./m.$^2$.

A sample of the element was imagewise-exposed and processed according to the procedure described in Example 3.

After 5 min., the elements were separated and a well-defined cyan dye image (Dmax 1.28, Dmin 0.18) was observed in the receiver.

EXAMPLE 5

One-Color Nitro-Substituted BEND Compound with Electron Donor in the Processing composition A photographic image-transfer-type element was prepared having the following structure:

Layer 1 — poly(ethylene terephthalate) film support;
Layer 2 — a silver bromide emulsion (0.8 $\mu$) at 1.08 g. Ag/m.$^2$, gelatin at 1.61 g./m.$^2$, BEND-13 at 0.44 g./m.$^2$ and diethyl lauramide at 0.44 g./m.$^2$; and
Layer 3 — hardened gelatin at 0.51 g./m.$^2$.

A sample of the element was exposed through a graduated-density test object and processed by rupturing a pod containing a processing composition comprising 51 g. potassium hydroxide, 20 g. potassium bromide, 0.5 g. 4-methyl-4-hydroxymethyl-1-phenyl-3-pyrazolidone, 3.0 g. N-methyl-5,7-dicarboxy-2,1-benzisoxazolone and 40 g. carboxymethylcellulose per liter of water while in contact with a receiving element as described in Example 3.

After 5 min., the elements were separated and a well-defined positive cyan dye image (Dmax 1.01, Dmin 0.30) was observed in the receiver.

EXAMPLE 6

Three-Color Element with Nitro-Substituted BEND Compounds and Incorporated Electron Donors A multilayer, multicolor image-transfer-type photographic element was prepared having the following structure:

Layer 1 — a cellulose acetate film support;
Layer 2 — a red-sensitive silver bromoiodide emulsion (0.8 $\mu$) at 1.08 g. Ag/m.$^2$, gelatin at 2.15 g./m.$^2$, BEND-7 at 0.42 g./m.$^2$, Electron Donor ED-1 at 0.63 g./m.$^2$ and 2,4-di-n-amylphenol at 1.05 g./m.$^2$;
Layer 3 — gelatin at 1.61 g./m.$^2$, a magenta filter dye at 0.32 g./m.$^2$, 2,4-di-sec-dodecylhydroquinone at 0.22 g./m.$^2$ and diethyl lauramide at 0.16 g./m.$^2$;
Layer 4 — a green-sensitive silver bromoiodide emulsion (0.8 $\mu$) at 1.61 g. Ag/m.$^2$, gelatin at 3.22 g./m.$^2$, BEND-18 at 0.70 g./m.$^2$, Electron Donor ED-1 at 1.27 g./m.$^2$ and 2,4-di-n-amylphenol at 1.97 g./m.$^2$;
Layer 5 — gelatin at 2.15 g./m.$^2$, a magenta filter dye at 1.08 g./m.$^2$, 2,4-di-sec-dodecylhydroquinone at 0.22 g./m.$^2$ and diethyl lauramide at 0.54 g./m.$^2$;
Layer 6 — a blue-sensitive silver bromoiodide emulsion (0.8 $\mu$) at 1.61 g. Ag/m.$^2$, gelatin at 3.22 g./m.$^2$, BEND-12 at 0.58 g./m.$^2$, Electron Donor ED-1 at 1.32 g./m.$^2$ and 2,4-di-n-amylphenol at 1.89 g./m.$^2$;
Layer 7 — hardened gelatin at 0.86 g./m.$^2$.

A sample of the element was exposed with a white light source and selectively filtered light sources consisting of red, green, blue, cyan, magenta and yellow, each focused on a separate portion of the element.

The exposed sample was processed by rupturing a pod containing 51 g. potassium hydroxide, 20 g. potassium bromide, 3.0 g. 4-methyl-4-hydroxymethyl-1-phenyl-3-pyrazolidone, 2.0 g. 5-methylbenzotriazole and 40 g. carboxymethyl cellulose per liter of water while in contact with a receiving element containing copoly(styrene--co-N,N,N-tri-n-hexyl-N-vinylbenzylammonium chloride) at 2.15 g./m.$^2$ and gelatin at 2.15 g./m.$^2$.

After 10 min., the photosensitive element and the receiver element were separated and the reflection densities of the transferred dyes were measured on the receiver as follows:

| | Reflecion Dye Density | | |
|---|---|---|---|
| Exposure | Red | Green | Blue |
| none | 1.86 | 1.54 | 1.64 |
| white | 0.28 | 0.41 | 0.36 |
| yellow | 0.30 | 0.52 | 1.24 |
| magenta | 0.44 | 1.18 | 0.60 |
| cyan | 1.78 | 0.75 | 0.56 |
| red | 0.41 | 1.30 | 1.52 |
| green | 1.78 | 0.86 | 1.39 |
| blue | 1.93 | 1.50 | 0.82 |

EXAMPLE 7

A photographic element was prepared by coating a poly(ethylene terephthalate) film support with a layer containing gelatin at 2.16 g./m.$^2$, a negative-working silver bromide emulsion at 100 mg./ft.$^2$ based on silver (1.08 g. Ag/m.$^2$), the BEND compound at $3.78 \times 10^{-4}$ moles/m.$^2$ except for BEND-4 which is $5.4 \times 10^{-4}$ moles/m.$^2$, and a hydrolyzable electron donor at $7.56 \times 10^{-4}$ moles/m.$^2$ except for ED-6 which is $1.08 \times 10^{-3}$ moles/m.$^2$. The BEND compound and the electron donor were dissolved in an equal weight of diethyl lauramide and dispersed together in gelatin before coating. A suitably hardened overcoat layer containing gelatin at 0.86 g./m.$^2$ was then applied.

Samples of the element were imagewise-exposed through a graduated-density test object and processed by rupturing pods containing a portion of viscous processing compositions containing 51 g. of potassium hydroxide, 20 g. of potassium bromide, 3.0 g. of 4-hydroxymethyl-4-methyl-1-phenyl-3-pyrazolidone, 51 g. of carboxymethyl cellulose and either 1.0, 2.0 or 4.0 g. of 5-methylbenzotriazole/liter of water while in contact with samples of a receiver element containing the dye mordant poly(divinylbenzene—co-styrene— co-N-benzyl-N,N-dimethyl-N-vinylbenzylammonium chloride).

After 10 min., the photosensitive elements and the receiver were separated, and well defined, positive dye images were observed in each receiver element. The minimum and maximum densities to the appropriate light sources of each dye image were measured and are recorded in the following table:

| Element | BEND Compound No. | Electron Donor No. | 5-Methyl-benzotri-azole (g./l.) | Dmax | Dmin |
|---|---|---|---|---|---|
| A | 19 | ED-5 | 1 | 1.65 | 0.16 |
| B | 20 | ED-5 | 1 | 2.26 | 0.14 |
| C | 4 | ED-6 | 4 | 2.24 | 0.14 |
| D | 5 | ED-5 | 2 | 1.75 | 0.16 |
| E | 6 | ED-5 | 4 | 1.75 | 0.12 |

EXAMPLE 8

Three-Color Integral-Negative Receiver Color Transfer Element and Process

A photographic integral-imaging-receiver transfer element was prepared by coating a transparent polyethylene terephthalate film support with the following layers in order from the support:

Layer 1 — a receiving layer containing gelatin at 2.16 g./m.$^2$ and poly(styrene-co-N,N,N-tri-n-hexyl-N-vinylbenzylammonium chloride) at 2.16 g./m.$^2$;

Layer 2 — a white reflecting layer containing gelatin at 3.89 g./m.$^2$ and titanium dioxide at 21.6 g./m.$^2$;

Layer 3 — an opacifying layer containing gelatin at 2.7 g./m.$^2$ and carbon at 1.62 g./m.$^2$;

Layer 4 — a red-sensitive, cyan dye-providing layer containing a red-sensitized, negative-working silver bromoiodide emulsion at 1.08 g. Ag/m.$^2$, BEND Compound No. 7 at 0.42 g./m.$^2$, Electron Donor No. Ed-1 at 0.64 g./m.$^2$, 2,4-di-n-amylphenol at 1.06 g./m.$^2$ and gelatin at 2.16 g./m.$^2$;

Layer 5 — an interlayer containing gelatin at 1.62 g./m.$^2$, 2,5-di-sec-dodecylhydroquinone at 0.22 g./m.$^2$, diethyl lauramide at 0.16 g./m.$^2$ and a magenta filter dye;

Layer 6 — a green-sensitive, magenta dye-providing layer containing a green-sensitized, negative-working silver bromoiodide emulsion at 1.62 g. Ag/m.$^2$, BEND Compound No. 21 at 0.67 g./m.$^2$, Electron Donor No. ED-1 at 1.22 g./m.$^2$, 2,4-di-n-amylphenol at 1.89 g./m.$^2$ and gelatin at 3.24 g./m.$^2$;

Layer 7 — an interlayer containing gelatin at 2.16 g./m.$^2$, 2,5-di-sec-dodecylhydroquinone at 0.22 g./m.$^2$ and a yellow filter dye;

Layer 8 — a blue-sensitive, yellow dye-providing layer containing a blue-sensitized, negative-working silver bromoidide emulsion at 1.62 g. Ag/m.$^2$, BEND Compound No. 12 at 0.58 g./m.$^2$, Electron Donor No. ED-1 at 1.32 g./m.$^2$, 2,4-di-n-amylphenol at 1.89 g./m.$^2$ and gelatin at 3.24 g./m.$^2$; and Layer 9 — a hardened overcoat layer containing gelatin at 0.86 g./m.$^2$.

A sample of the above-prepared photographic element was selectively exposed through a multicolor graduated-density test object comprising white, red, green, blue, cyan, magenta and yellow filtered light sources, each focused on a separate portion of the element.

The exposed sample was processed at 24° C. by laminating to a processing cover sheet and rupturing a pod containing a portion of a viscous processing compositing comprising 51 g. of potassium hydroxide, 20 g. of potassium bromide, 3.0 g. of 4-hydroxymethyl-4-methyl-1-phenyl-3-pyrazolidone, 2.0 g. of 5-methylbenzotriazole, 51 g. of carboxymethyl cellulose and 1.0 liter of water.

The cover sheet is of the type disclosed by Hannie and Ducharm, U.S. Serial No. 676,947 filed April 14, 1976, which consists of a transparent polyethylene terephthalate film support having coated thereon:

(1) a layer of poly(butyl acrylate-co-acrylic acid)

(2) a timing layer containing a mixture of cellulose acetate and poly(styrene-co-maleic anhydride); and (3) a second timing layer containing a latex dispersion of poly(acrylonitrile-co-vinylidene chloride-co-acrylic acid).

In addition, an opaque backing was applied to the opposite side of the cover sheet support to allow processing in ambient light.

After 15 min., the densities to red, green and blue light were measured and are recorded in the following table.

| Exposure | Reflection Density Red | Green | Blue |
|---|---|---|---|
| cyan | 1.30 | 0.50 | 0.45 |
| magenta | 0.34 | 1.40 | 0.65 |
| yellow | 0.18 | 0.46 | 1.75 |
| white | 0.18 | 0.35 | 0.48 |
| red | 0.36 | 1.62 | 1.95 |
| green | 1.72 | 0.60 | 1.85 |
| blue | 2.00 | 1.85 | 0.85 |
| none | 1.80 | 1.76 | 1.93 |

In the above example, good results are also obtained when a transparent cover sheet is used along with a processing composition containing sufficient carbon in the processing composition to preclude adverse exposure to roomlight through the layer of processing composition.

Although the invention has been described in considerable detail with particular reference to certain preferred embodiments thereof, variations and modifications can be effected within the spirit and scope of the invention.

What is claimed is:

1. A photographic element comprising at least one alkali-permeable layer containing a photographic light-sensitive silver halide having associated therewith a BEND compound having the formula:

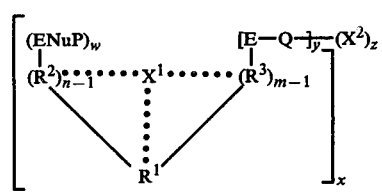

wherein w, x, y, z, n and m are positive integers of 1 or 2; ENuP is an electron-accepting nucleophilic precursor group; $R^1$ is an organic group providing a cyclic group to which ENuP and E are attached optionally through $R^2$ and $R^3$; $R^2$ and $R^3$ are bivalent organic groups containing from 1–3 atoms in the bivalent linkage; E and Q provide an electrophilic cleavage group where E is an electrophilic group and Q is a bivalent group providing a monoatom linkage between E and $X^2$ and which can be displaced from E by the nucleophilic group provided by ENuP, and Q is an amino group, an oxygen atom, a selenium atom or a sulfur atom; $X^1$ is a substituent on at least one of $R^1$, $R^2$ and $R^3$, and one of $X^1$ or Q—$X^2$ is a ballasting group of sufficient size to render said compound immobile in an alkali-permeable layer of a photographic element, and one of $X^1$ and Q—$X^2$ is an image dye-providing material or a photographic reagent.

2. A photographic element according to claim 1 wherein ENuP is a nitro group.

3. A photographic element according to claim 2 comprising an alkali-permeable layer containing a blue-sensitive silver halide having associated therewith a BEND compound of said formula wherein (—Q—$X^2$) is a diffusible yellow-dye moiety, an alkali-permeable layer containing a green-sensitive silver halide having associated therewith a BEND compound of said formula wherein (—Q—$X^2$) is a diffusible magenta-dye moiety, and an alkali-permeable layer containing a red-sensitive silver halide having associated therewith a BEND compound of said formula wherein (—Q— $X^2$) is a diffusible cyan-dye moiety.

4. A photographic element according to claim 2 wherein each of said silver halide emulsions has associated therewith an alkali-labile electron-donor precursor.

5. A photographic element according to claim 3 wherein each of said silver halide emulsions has associated therewith a hydrolyzable precursor for an electron donor which has a redox $t_{\frac{1}{2}}$ with said BEND compound of at least 5 seconds.

6. A photographic element according to claim 3 wherein each of said silver halide emulsions has associated therewith a substantially immobile hydrolyzable precursor for an electron donor.

7. A photographic element according to claim 1 wherein ENuP is an oxo group and Q is an amino group.

8. A photographic element according to claim 1 wherein E is a carbonyl group or sulfonyl.

9. A photographic element according to claim 1 wherein $R^1$ is an organic group which provides a cyclic aromatic group to which ENuP and E are attached.

10. A photographic element according to claim 1 wherein said silver halide has associated therewith an electron donor which has a redox $t_{\frac{1}{2}}$ of from 5 seconds to 30 minutes with said BEND.

11. A photographic element comprising a support and at least one layer thereon containing a photographic, light-sensitive silver halide having associated therewith a BEND compound having the formula:

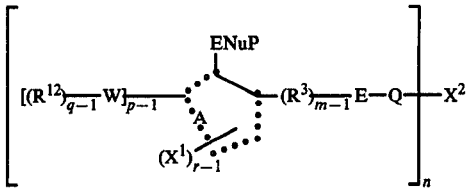

where ENuP is an electron-accepting precursor for an hydroxylamine nucleophilic group; A represents a group containing the atoms necessary to form an aromatic ring with the remainder of said formula; W is an electron-withdrawing group; $R^{12}$ is a hydrogen atom, an alkyl group or an aryl group; $R^3$ is a bivalent organic group containing from 1–3 atoms in the bivalent linkage; m and q are positive integers of 1 or 2; p and r are positive integers of 1 or greater with $[(R^{12})_{q-1}W]$ being a substituent on any portion of the aromatic-ring structure of A; E and Q provide an electrophilic cleavage group where E is an electrophilic center and Q is a bivalent group providing a monoatom linkage between E and $X^2$ wherein said bivalent group can be an oxygen atom, a sulfur atom, a selenium atom or a nitrogen atom which provides an amino group; n is an integer of 1–3; $X^2$, together with Q, is either an image dye-providing material or a photographic reagent; $X^1$ is a ballasting group; and at least one of $X^1$ and $R^{12}$ is present in said compound and is of a size sufficient to render said compound immobile.

12. A photographic element according to claim 11 wherein n and m are 1, Q is an amino group, E is a carbonyl group, Q—$X^2$ is an image dye-providing moiety, and ENuP is a nitro group.

13. A photographic element according to claim 12 wherein n and m are 1 and A represents a group containing the atoms necessary to form a carbocyclic aromatic ring to which ENuP and E are attached.

14. A photographic element according to claim 11 wherein P is 2 or greater, W is a sulfonyl group, ENuP is a nitro group, $R^{12}$ is a ballasting group and A represents a group containing the atoms necessary to form a 6-membered carbocyclic aromatic ring with the remainder of said formula.

15. A photographic element according to claim 11 comprising an alkali-permeable layer containing a blue-sensitive silver halide having associated therewith a BEND compound of said formula wherein (—Q—$X^2$) is a diffusible yellow-dye moiety, an alkali-permeable layer containing a green-sensitive silver halide having associated therewith a BEND compound of said formula wherein (—Q—$X^2$) is a diffusible magenta-dye moiety, and an alkali-permeable layer containing a red-sensitive silver halide having associated therewith a BEND compound of said formula wherein (—Q—$X^2$) is a diffusible cyan-dye moiety.

16. A photographic element according to claim 15 wherein ENuP is a nitro group and p is an integer of 3 or greater.

17. A photographic element according to claim 15 wherein each of said silver halide emulsions has associated therewith a hydrolyzable precursor for an electron donor which has a redox $t_{\frac{1}{2}}$ with said BEND compound of greater than 5 seconds.

18. A photographic element according to claim 15 wherein each of said silver halide emulsions has associated therewith a substantially immobile hydrolyzable precursor for an electron donor.

19. A photographic element according to claim 18 wherein each (—Q—$X^2$) is an azo dye and each of n and m is 1.

20. A photographic element according to claim 11 wherein each of said silver halide emulsions has associated therewith a hydrolyzable electron-donor precursor.

21. A photographic element comprising a support having thereon at least one layer containing a photographic, light-sensitive silver halide having associated therewith a BEND compound having the formula:

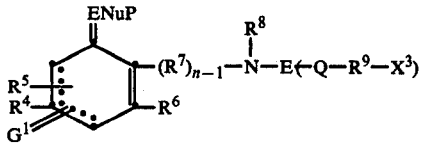

wherein ENuP is an electron-accepting nucleophilic precursor for an hydroxy nucleophilic group; E is carbonyl or thiocarbonyl; Q is a bivalent group providing a monoatom linkage between E and $R^9$ wherein said monoatom is a nonmetallic atom of Group VA or VIA of the periodic table in its minus 2 or minus 3 valence state; $G^1$ is an imido group or any of the groups specified for ENuP; $R^7$ is a bivalent alkylene group containing from 1–3 atoms in the bivalent linkage; n is a positive integer of 1 or 2; $R^9$ can be an aromatic group containing from 6–20 carbon atoms or an alkylene group containing 1–12 carbon atoms; $R^8$ can be an alkyl group containing from 1–40 carbon atoms, an aryl group containing from 6–20 carbon atoms, or the substituent $X^1$; $R^6$, $R^4$ and $R^5$ can each be monoatom groups which can be hydrogen atoms, halogen atoms or polyatomic groups which can be alkyl groups, aryl groups, carbonyl groups, sulfamyl groups, sulfonamido groups or the sbustituent $X^1$, and the substituents for $R^6$ and $R^5$ or $R^4$ and $R^5$ when on adjacent positions on the ring may be taken together to form a 5- or 6-membered ring with the remainder of the molecule with the provision that, when $R^9$ is an alkylene group, $R^6$ and $R^4$ are polyatomic groups, and when $G^1$ is a substituent defined for ENuP, an adjacent $R^6$ or $R^4$ can be the group:

$$-(R^7)_{n-1}-\overset{\overset{\displaystyle R^8}{|}}{N}-E-(Q-R^9-X^3) \quad ;$$

$X^1$ is provided in at least one of the substituent positions and is a ballasting group of sufficient size to render said compound immobile in an alkali-permeable layer of the photographic element, or is a photographically useful moiety which is an image dye-providing material or a photographic reagent; $X^3$ is a group which, together with Q and $R^9$, can be a ballasting group or photographically useful group as defined for $X^1$, provided one of $X^1$ and $-(Q-R^9-X^3)$ is said ballasting group and one of $X^1$ and $-(Q-R^9-X^3)$ is said photographically useful group.

22. A photographic element according to claim 21 wherein ENuP is an oxo group.

23. A photographic element according to claim 21 wherein $G^1$ is an oxo group and $R^4$ is said group:

$$-(R^7)_{n-1}-\overset{\overset{\displaystyle R^8}{|}}{N}-E-(Q-R^9-X^3)$$

and each $-(Q-R^9-X^3)$ is an image dye-providing moiety.

24. A photographic element according to claim 21 wherein $-(Q-R^9-X^3)$ is an image dye-providing material.

25. A photographic element according to claim 21 wherein $R^6$, $R^4$ and $R^5$ are polyatomic substituents and $R^9$ is an alkylene group.

26. A photographic element according to claim 21 wherein Q is an oxygen atom, $R^9$ is an aromatic group and ENuP is an oxo group.

27. A photographic element according to claim 21 comprising an alkali-permeable layer containing a blue-sensitive silver halide having associated therewith a BEND compound of said formula wherein $-(Q-R^9-X^3)$ is a diffusible yellow-dye moiety, an alkali-permeable layer containing a green-sensitive silver halide having associated therewith a BEND compound of said formula wherein $-(Q-R^9-X^3)$ is a diffusible magenta-dye moiety, and an alkali-permeable layer containing a red-sensitive silver halide having associated therewith a BEND compound of said formula wherein $-(Q-R^9-X^3)$ is a diffusible cyan-dye moiety.

28. A photographic element according to claim 21 wherein each of said silver halide emulsions has associated therewith a hydrolyzable electron-donor precursor.

29. A photographic element according to claim 21 wherein each of said silver halide emulsions has associated therewith a hydrolyzable precursor for an electron donor which has a redox $t_{\frac{1}{2}}$ with said BEND compound of greater than 5 seconds.

30. A photographic element according to claim 21 wherein each of said silver halide emulsions has associated therewith a substantially immobile hydrolyzable precursor for an electron donor.

31. An image-transfer film unit comprising:

(a) a photographic element comprising a support having at least one alkali-permeable layer thereon containing a photographic, light-sensitive, silver halide composition which has associated therewith a BEND compound having the formula:

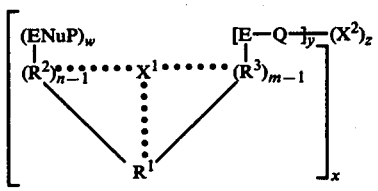

where w, x, y, z, n and m are positive integers of 1 or 2; ENuP is an electron-accepting nucleophilic precursor group; $R^1$ is an organic group providing a cyclic group to which ENuP and E are attached optionally through $R^2$ and $R^3$; $R^2$ and $R^3$ are bivalent organic groups containing from 1–3 atoms in the bivalent linkage; E and Q provide an electrophilic cleavage group where E is an electrophilic group and Q is a bivalent group providing a monoatom linkage between E and $X^2$ and which can be displaced from E by the nucleophilic group provided by ENuP, and Q is an amino group, an oxygen atom or a sulfur atom; $X^1$ is a substituent on at least one of $R^1$, $R^2$ and $R^3$, and one of $X^1$ or $Q-X^2$ is a ballasting group of sufficient size to render said compound immobile in an alkali-permeable layer of a photographic element, and one of $X^1$ and $Q-X^2$ is an image dye-providing material or a photographic reagent;

(b) an image-receiving layer;

(c) a container means containing an alkaline processing composition; and (d) either (i) an electron donor which is a silver halide developer or (ii) an electron donor in combination with an electron transfer agent which is a silver halide developer.

32. A film unit according to claim 31 wherein $Q-X^2$ is an image-dye moiety.

33. A film unit according to claim 31 wherein $R^1$ is a group containing the atoms necessary to form a carbocyclic aromatic group with the remainder of said formula, $X^1$ is a substituent on $R^1$ and $Q-X^2$ is an image dye-providing moiety.

34. A film unit according to claim 31 wherein said electron donor is a hydrolyzable electron donor.

35. A film unit according to claim 31 which contains an electron donor which is a benzisoxazolone compound and an electron-transfer agent which is a 3-pyrazolidone compound.

36. A film unit according to claim 31 wherein said electron donor is substantially immobile in the alkali-permeable layers of said film unit.

37. A film unit according to claim 31 wherein said electron donor has a redox $t\frac{1}{2}$ of at least 5 seconds and less than 30 minutes with said BEND compound.

38. A film unit according to claim 31 wherein said photographic element comprises an alkali-permeable layer containing a blue-sensitive silver halide having associated therewith a BEND compound of said formula wherein $Q—X^2$ is a diffusible yellow-dye moiety, an alkali-permeable layer containing a green-sensitive silver halide having associated therewith a BEND compound of said formula wherein said $Q—X^2$ is a diffusible magenta-dye moiety, and an alkali-permeable layer containing a red-sensitive silver halide having associated therewith a BEND compound of said formula wherein said $Q—X^2$ is a diffusible cyan-dye moiety.

39. An image-transfer film unit comprising:

(a) A photographic element comprising a support having at least one alkali-permeable layer thereon containing a photographic, light-sensitive silver halide emulsion which has associated therewith a BEND compound having the formula:

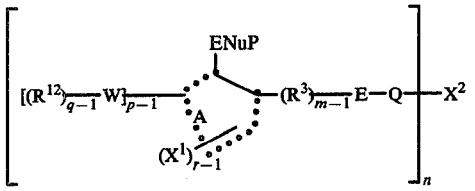

wherein ENuP is an electron-accepting precursor for an hydroxylamine nucleophilic group; A represents a group containing the atoms necessary to form an aromatic ring with the remainder of said formula; W is an electron-withdrawing gorup; $R^{12}$ is a hydrogen atom, an alkyl group or an aryl group; $R^3$ is a bivalent organic group containing from 1–3 atoms in the bivalent linkage; m and q are positive integers of 1 or 2; p and r are positive integers of 1 or greater, with $[(R^{12})_{q-1}W]$ being a substituent on any portion of the aromatic-ring structure of A; E and Q provide an electrophilic cleavage group where E is an electrophilic center and Q is a bivalent group providing a monoatom linkage between E and $X^2$ wherein said bivalent group can be an oxygen atom, a sulfur atom, a selenium atom or a nitrogen atom which provides an amino group; n is an integer of 1–3; $X^2$, together with Q, is either an image dye-providing material or a photographic reagent; $X^1$ is a ballasting group; and at least one of $X^1$ and $R^{12}$ is present in said compound and is of a size sufficient to render said compound immobile;

(b) an image-receiving layer;

(c) a container means containing an alkaline processing composition; and (d) an electron donor in combination with an electron-transfer agent which is a silver halide developer.

40. A film unit according to claim 39 wherein n and m are 1, Q is an amino group, E is a carbonyl group, $Q—X_2$ is an image dye-providing moiety, and ENuP is a nitro group.

41. A film unit according to claim 39 wherein n and m are 1 and A represents a group containing the atoms necessary to form a carbocyclic aromatic ring to which ENuP and E are attached.

42. A film unit according to claim 39 wherein p is 2 or greater, W is a sulfonyl group, ENuP is a nitro group, $X^1$ is a ballasting group and A represents a group containing the atoms necessary to form a 6-membered carbocyclic aromatic ring with the remainder of said formula.

43. A film unit according to claim 39 wherein said photographic element comprises an alkali-permeable layer containing a blue-sensitive silver halide having associated therewith a BEND compound of said formula wherein said $Q—X^2$ is a diffusible yellow-dye moiety, an alkali-permeable layer containing a green-sensitive silver halide having associated therewith a BEND compound of said formula wherein $Q—X^2$ is a diffusible magenta-dye moiety, and an alkali-permeable layer containing a red-sensitive silver halide having associated therewith a BEND compound of said formula wherein $Q—X^2$ is a diffusible cyan-dye moiety.

44. A film unit according to claim 43 wherein each of said silver halide emulsions has associated therewith a hydrolyzable electron-donor precursor.

45. A film unit according to claim 43 wherein each of said silver halide emulsions has associated therewith a hydrolyzable precursor for an electron donor which has a redox $t\frac{1}{2}$ with said BEND compound of greater than 5 seconds.

46. A film unit according to claim 43 wherein said electron donor has the formula:

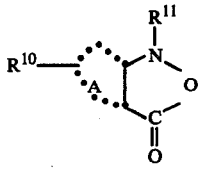

wherein A represents a group containing the atoms necessary to form a 5- to 7-membered aromatic ring with the remainder of said formula; $R^{10}$ represents a hydrogen atom or one or more organic groups containing from 1–30 carbon atoms; and $R^{11}$ is an alkyl group containing from 1–30 carbon atoms or an aryl group containing from 6–30 carbon atoms.

47. An image-transfer film unit comprising:

(a) a photographic element comprising a support having at least one alkali-permeable layer thereon containing a photographic, light-sensitive silver halide composition which has associated therewith a BEND compound having the formula:

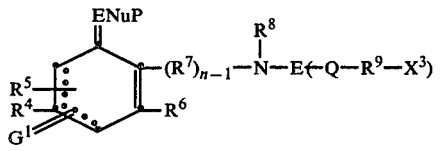

wherein ENuP is an electron-accepting nucleophilic precursor for an hydroxy nucleophilic group; E is carbonyl or thiocarbonyl; Q is a bivalent group providing a monoatom linkage between E and $R^9$ wherein said monoatom is a nonmetallic atom of Group VA or VIA of the periodic table in its minus 2 or minus 3 valence state; $G^1$ is an imino group or any of the groups specified for ENuP; $R^7$ is a bivalent alkylene group containing from 1-3 atoms in the bivalent linkage; n is a positive integer of 1 or 2; $R^9$ can be an aromatic group containing from 6-20 carbon atoms or an alkylene group containing 1-12 carbon atoms; $R^8$ can be an alkyl group containing from 1-40 carbon atoms, an aryl group containing from 6-20 carbon atoms, or the substituent $X^1$; $R^6$, $R^4$ and $R^5$ can each be monoatom groups which can be hydrogen atoms, halogen atoms or polyatomic groups which can be alkyl groups, aryl groups, carbonyl groups, sulfamyl groups, sulfonamido groups or the substituent $X^1$, and the substituents for $R^6$ and $R^5$ or $R^4$ and $R^5$ when on adjacent positions on the ring may be taken together to form a 5- or 6-membered ring with the remainder of the molecule with the provision that, when $R^9$ is an alkylene group, $R^6$ and $R^4$ are polyatomic groups, and when $G^1$ is a substituent defined for ENuP, an adjacent $R^6$ or $R^4$ can be the group:

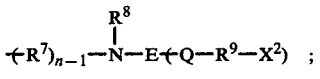

$X^1$ is provided in at least one of the substituent positions and is a ballasting group of sufficient size to render said compound immobile in an alkali-permeable layer of the photographic element, or is a photographically useful moiety which is an image dye-providing material or a photographic reagent; $X^3$ is a group which, together with Q and $R^9$, can be a ballasting group or a photographically useful group as defined for $X^1$, provided one of $X^1$ and $-(Q-R^9-X^3)$ is said ballasting group and one of $X^1$ and $-(Q-R^9-X^3)$ is said photographically useful group;

(b) an image-receiving layer;

(c) a container means containing an alkaline processing composition; and (d) either (i) an electron donor which is a silver halide developer or (ii) an electron donor in combination with an electron-transfer agent which is a silver halide developer.

48. A film unit according to claim 49 wherein $-Q-R^9-X^3)$ is an image-dye moiety.

49. A film unit according to claim 49 wherein ENuP is an oxo group.

50. A flm unit according to claim 49 wherein $G^1$ is an oxo group and $R^4$ is said group:

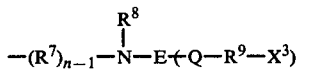

and each $-(Q-R^9-X^3)$ is an image dye-providing moiety.

51. A film unit according to claim 47 wherein $R^6$, $R^4$ and $R^5$ are polyatomic substituents and $R^9$ is an alkylene group.

52. A film unit according to claim 47 wherein Q is an oxygen atom, $R^9$ is an aromatic group and ENuP is an oxo group.

53. A film unit according to claim 47 wherein said photographic element comprises an alkali-permeable layer containing a blue-sensitive silver halide having associated therewith a BEND compound of said formula wherein $-(Q-R^9-X^3)$ is a diffusible yellow-dye moiety, an alkali-permeable layer containing a green-sensitive silver halide having associated therewith a BEND compound of said formula wherein $-(Q-R^9-X^3)$ is a diffusible magenta-dye moiety, and an alkali-permeable layer containing a red-sensitive silver halide having associated therewith a BEND compound of said formula wherein $-(Q-R^9-X^3)$ is a diffusible cyan-dye moiety.

54. A film unit according to claim 53 wherein each of said silver halide emulsions has associated therewith a hydrolyzable electron-donor precursor.

55. A film unit according to claim 53 wherein each of said silver halide emulsions has associated therewith an electron donor which is a benzisoxazolone compound and said film unit contains an electron-transfer agent which is a 3-pyrazolidone compound.

56. A film unit according to claim 53 wherein each of said BEND compounds contains at least two dye moieties and ENuP and G are oxo groups.

57. An image-transfer film unit comprising:

(a) a photographic element containing a support having coated thereon, in order:

(i) an image dye-receiving layer;

(ii) a white reflective layer;

(iii) an opaque layer having sufficient opacity, together with said reflective layer, to preclude adverse exposure through said layers during normal roomlight processing of the film unit; and (iv) a layer containing a silver halide emulsion having associated therewith a BEND compound having the formula:

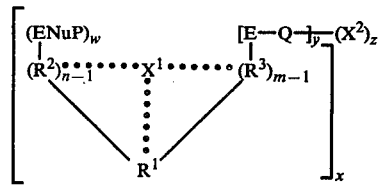

where w, x, y, z, n and m are positive integers of 1 or 2; ENuP is an electron-accepting nucleophilic precursor group; $R^1$ is an organic group providing a cyclic group to which ENuP and E are attached optionally through $R^2$ and $R^3$; $R^2$ and $R^3$ are bivalent organic groups containing from 1-3 atoms in the bivalent linkage; E and Q provide an electrophilic cleavage group where E is an electrophilic group and Q is a bivalent group providing a monoatom linkage between E and $X^2$ and which can be displaced from E by the nucleophilic group provided by ENuP, and Q is an amino group, an oxygen atom or a sulfur atom; $X^1$ is a substituent on at least one of $R^1$, $R^2$ and $R^3$, and one of $X^1$ or Q—$X^2$ is a ballasting group of sufficient size to render said compound immobile in an alkali-permeable layer of a photographic element, and one of $X^1$ and Q—$X^2$ is an image dye-providing material;

(b) an image dye-receiving layer;

(c) a container means containing an alkaline processing composition; and (d) either (i) an electron donor which is a silver halide developer or (ii) an electron donor in combination with an electron-transfer agent which is a silver halide developer.

58. An image-transfer film unit according to claim 57 wherein said processing composition contains an opacifying material which forms an opaque layer which precludes adverse exposure through said layer during normal roomlight processing when spread in a uniform layer over said photographic element and wherein said film unit comprises a superposed transparent cover sheet.

59. An image-transfer film unit according to claim 57 wherein said film unit contains an electron-transfer agent in combination with an electron donor which is a hydrolyzable electron donor.

60. An image-transfer film unit according to claim 57 wherein said photographic element comprises an alkali-permeable layer containing a blue-sensitive silver halide having associated therewith a BEND compound of said formula wherein said Q—$X^2$ is a diffusible yellow-dye moiety, an alkali-permeable layer containing a green-sensitive silver halide having associated therewith a BEND compound of said formula wherein said Q—$X^2$ is a diffusible magenta-dye moiety, and an alkali-permeable layer containing a red-sensitive silver halide having associated therewith a BEND compound of said formula wherein said Q—$X^2$ is a diffusible cyan-dye moiety.

61. An image-transfer film unit according to claim 57 which comprises said electron donor in combination with said electron-transfer agent, wherein said BEND compound has the formula:

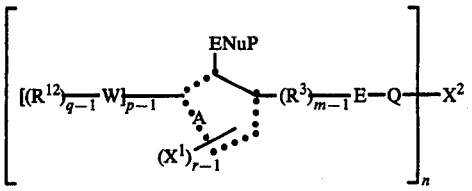

wherein ENuP is an electron-accepting precursor for an hydroxylamine nucleophilic group; A represents a group containing the atoms necessary to form an aromatic ring with the remainder of said formula; W is an electron-withdrawing group; $R^{12}$ is a hydrogen atom, an alkyl group or an aryl group; $R^3$ is a bivalent organic group containing from 1–3 atoms in the bivalent linkage; m and q are positive integers of 1 or 2; p and r are positive integers of 1 or greater, with $[(R^{12})_{q-1}W]$ being a substituent on any portion of the aromatic-ring structure of A; E and Q provide an electrophilic cleavage group where E is an electrophilic center and Q is a bivalent group providing a monoatom linkage between E and $X^2$ wherein said bivalent group can be an oxygen atom, a sulfur atom, a selenium atom or a nitrogen atom which provides an amino group; n is an integer of 1–3; $X^2$, together with Q, is an image dye-providing material; $X^1$ is a ballasting group and at least one of $X^1$ and $R^{12}$ is present in said compound and is of a size sufficient to render said compound immobile.

62. An image-transfer film unit according to claim 61 wherein said BEND compound has the formula:

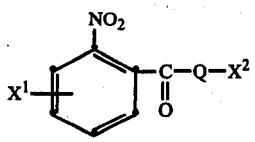

wherein Q is an amino group; Q—$X^2$ is an image dye moiety; and $X^1$ is a ballasting group of sufficient size to render said BEND immobile in the alkali-permeable layers of said film unit.

63. An image-transfer film unit according to claim 61 wherein said electron donor has the formula:

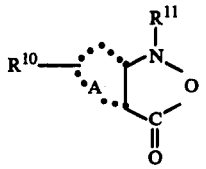

wherein A represents a group containing the atoms necessary to form a 6-membered aromatic ring with the remainder of said formula; $R^{10}$ represents a N-alkylcarbamoyl group containing at least 8 carbon atoms; and $R^{11}$ is an alkyl group containing from 1–30 carbon atoms.

64. An image-transfer film unit according to claim 57 wherein said BEND compound has the formula:

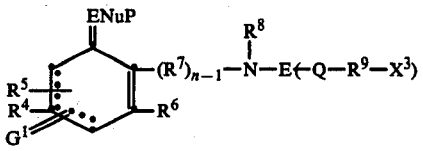

wherein ENuP is an electron-accepting nucleophilic precursor for an hydroxy nucleophilic group; E is carbonyl or thiocarbonyl; Q is a bivalent group providing a monoatom linkage between E and $R^9$ wherein said monoatom is a nonmetallic atom of Group VA or VIA of the periodic table in its minus 2 or minus 3 valence state; $G^1$ is a dialkylamino group, a sulfonamido group or any of the groups specified for ENuP; $R^7$ is a bivalent alkylene group containing from 1–3 atoms in the bivalent linkage; n is a positive integer of 1 or 2; $R^9$ can be an aromatic group containing from 6–20 carbon atoms or an alkylene group containing 1–12 carbon atoms; $R^8$ can be an alkyl group containing from 1–40 carbon atoms, an aryl group containing from 6–20 carbon atoms, or the substituent $X^1$; $R^6$, $R^4$ and $R^5$ can each be monoatom groups which can be hydrogen atoms, halogen atoms or polyatomic groups which can be alkyl groups, aryl groups, carbonyl groups, sulfamyl groups, sulfonamido groups, or the substituent $X^1$, and the substituents for $R^6$ and $R^5$ or $R^4$ and $R^5$ when on adjacent positions on the ring may be taken together to form a 5- or 6-membered ring with the remainder of the molecule with the provision that, when $R^9$ is an alkylene group, $R^6$ and $R^4$ are polyatomic groups, and when $G^1$ is a substituent defined for ENuP, an adjacent $R^6$ or $R^4$ can be the group:

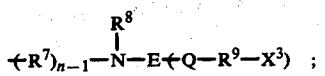

$X^1$ is provided in at least one of the substituent positions and is a ballasting group of sufficient size to render said compound immobile in an alkali-permeable layer of the photographic element, or is an image dye-providing moiety; $X^3$ is a group which, together with Q and $R^9$, can be a ballasting group or an image dye-providing moiety as defined for $X^1$, provided one of $X^1$ and $\text{-}(Q\text{—}R^9\text{—}X^3)$ is said ballasting group and one of $X^1$ and $\text{-}(Q\text{—}R^9\text{—}X^3)$ is said image dye-providing moiety.

65. An image-transfer film unit according to claim 64 wherein said film unit contains an electron donor which has the formula:

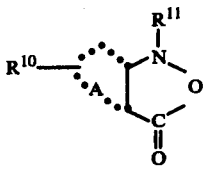

wherein A represents a group containing the atoms necessary to form a 5- to 6-membered aromatic ring with the remainder of said formula; $R^{10}$ represents a hydrogen atom or one or more organic groups containing from 1-30 carbon atoms; $R^{11}$ is an alkyl group containing from 1-30 carbon atoms or an aryl group containing from 6-30 carbon atoms.

66. An image-transfer film unit according to claim 64 wherein said BEND compound has the formula:

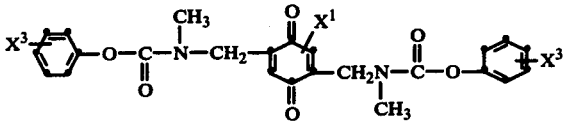

wherein $X^3$, together with the group:

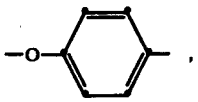

is an image-dye moiety and $X^1$ is one or more ballast groups.

67. A process of forming an image record in an photographic element which comprises at least one layer containing a silver halide emulsion which has been imagewise-exposed, having associated therewith a BEND compound having the formula:

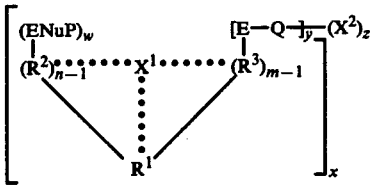

wherein w, x, y, z, n and m are positive integers of 1 or 2; ENuP is an electron-accepting nucleophilic precursor group; $R^1$ is an organic group providing a cyclic group to which ENuP and E are attached optionally through $R^2$ and $R^3$; $R^2$ and $R^3$ are bivalent organic groups containing from 1-3 atoms in the bivalent linkage; E and Q provide an electrophilic cleavage group where E is an electrophilic group and Q is a group providing a monoatom linkage between E and $X^2$ and which can be displaced from E by the nucleophilic group provided by ENuP, wherein said monoatom is a nitrogen atom, an oxygen atom or a sulfur atom; $X^1$ is a substituent on at least one of $R^1$, $R^2$ and $R^3$, and one of $X^1$ or $\text{-}(Q\text{—}X^2)$ is a ballasting group of sufficient size to render said compound immobile in an alkali-permeable layer of a photographic element, and one of $X^1$ and $\text{-}(Q\text{—}X^2)$ is a diffusible image dye-providing material; said process comprising contacting said photographic element with an alkaline processing composition in the presence of an electron donor which is a silver halide developing agent under conditions where the silver halide is developed as a function of exposure and said BEND compound is reduced as an inverse function of silver halide development, and said reduced BEND compound undergoes intramolecular nucleophilic displacement of said diffusible image dye-providing material with diffusion of said dye image-providing moiety away from its original location.

68. A process according to claim 67 wherein said electron donor is an ascorbic acid, a trihydroxypyrimidine or an hydroxylamine.

69. A process according to claim 67 wherein said photographic element comprises an alkali-permeable layer containing a blue-sensitive silver halide having associated therewith a BEND compound of said formula wherein said $\text{-}(Q\text{—}X^2)$ is a diffusible yellow-dye moiety, an alkali-permeable layer containing a green-sensitive silver halide having associated therewith a BEND compound of said formula wherein said $\text{-}(Q\text{—}X^2)$ is a diffusible magenta-dye moiety, and an alkali-permeable layer containing a red-sensitive silver halide having associated therewith a BEND compound of said formula wherein said $\text{-}(Q\text{—}X^2)$ is a diffusible cyan-dye moiety.

70. A process according to claim 67 wherein said dye moieties are azo dye moieties.

71. A process according to claim 67 wherein said displaced image dye-providing moiety is washed out of said element leaving a retained image of dye.

72. A process according to claim 67 wherein said silver halide is bleached and fixed out of said element after said development step.

73. A process according to claim 67 wherein said BEND compound has the formula:

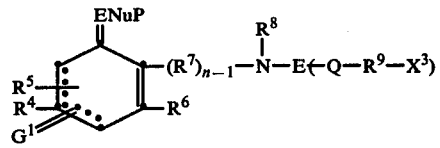

wherein ENuP is an electron-accepting nucleophilic precursor for an hydroxy nucleophilic group; E is carbonyl or thiocarbonyl; Q is a group providing a monoatom linkage between E and $R^9$ wherein said monoatom is a nonmetallic atom of Group VA or VIA of the periodic table in its minus 2 or minus 3 valence state; $G^1$ is an imido group or any of the groups specified for ENuP; $R^7$ is a bivalent alkylene group containing from 1–3 atoms in the bivalent linkage; n is a positive integer of 1 or 2; $R^9$ can be an aromatic group or an alkylene group; $R^8$ can be an alkyl group containing from 1–40 carbon atoms, an aryl group containing from 6–20 carbon atoms, or the substituent $X^1$; $R^6$, $R^4$ and $R^5$ can each be monoatom groups which can be hydrogen atoms, halogen atoms or polyatomic groups which can be alkyl groups, aryl groups, carbonyl groups, sulfamyl groups, sulfonamido groups or the substituent $X^1$, and the substituents for $R^6$ and $R^5$ or $R^4$ and $R^5$ when on adjacent positions on the ring may be taken together to form a 5- or 6-membered ring with the remainder of the molecule with the provision that, when $R^9$ is an alkylene group, $R^6$ and $R^4$ are polyatomic groups, and when $G^1$ is a substituent defined for ENuP, an adjacent $R^6$ or $R^4$ can be the group:

$$\text{-}(R^7)_{n-1}\text{-}\overset{R^8}{\overset{|}{N}}\text{-}E\text{-}(Q\text{-}R^9\text{-}X^2) \quad ;$$

$X^1$ is provided in at least one of the substituent positions and is a ballasting group of sufficient size to render said compound immobile in an alkali-permeable layer of the photographic element, or is an image dye-providing moiety; $X^3$ is a group which, together with Q and $R^9$, can be a ballasting group or an image dye-providing moiety as defined for $X^1$, provided one of $X^1$ and $\text{-}(Q\text{-}R^9\text{-}X^3)$ is said ballasting group and one of $X^1$ and $\text{-}(Q\text{-}R^9\text{-}X^3)$ is said image dye-providing moiety.

74. An image-transfer process comprising contacting an imagewise-exposed photographic element with an alkaline processing composition in the presence of an electron-transfer agent which is a silver halide developer, wherein said photographic element comprises at least one layer containing a silver halide emulsion having associated therewith an electron donor and a BEND compound having the formula:

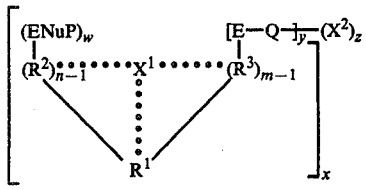

where w, x, y, z, n and m are positive integers of 1 or 2; ENuP is an electron-accepting nucleophilic precursor group; $R^1$ is an organic group providing a cyclic group to which ENuP and E are attached optionally through $R^2$ and $R^3$; $R^2$ and $R^3$ are bivalent organic groups containing from 1–3 atoms in the bivalent linkage; E and Q provide an electrophilic cleavage group where E is an electrophilic group and Q is a group providing a monoatom linkage between E and $X^2$ and which can be displaced from E by the nucleophilic group provided by ENuP, wherein said monoatom is a nitrogen atom, an oxygen atom or a sulfur atom; $X^1$ is a substituent on at least one of $R^1$, $R^2$ and $R^3$, and one of $X^1$ or $Q\text{—}X^2$ is a ballasting group of sufficient size to render said compound immobile in an alkali-permeable layer of a photographic element and one of $X^1$ and $Q\text{—}X^2$ is an image dye-providing material; said process being carried out under conditions where (a) said electron-transfer agent develops said silver halide as a function of exposure to provide oxidized electron-transfer agent, (b) said oxidized electron-transfer agent reacts with said electron donor to destroy an imagewise pattern of electron donor, (c) the inverse pattern of electron donor remaining transfers electrons to the BEND compound, reducing it to provide a nucleophilic group on said BEND compound, (d) said reduced BEND compound undergoes intramolecular nucleophilic displacement of the diffusible image dye-providing moiety, and (e) said diffusible image dye-providing moiety is transferred away from its original location.

75. An image-transfer process according to claim 74 wherein said photographic element comprises an alkali-permeable layer containing a blue-sensitive silver halide having associated therewith a BEND compound of said formula wherein $\text{-}(Q\text{—}X^2)$ is a diffusible yellow-dye moiety, an alkali-permeable layer containing a green-sensitive silver halide having associated therewith a BEND compound of said formula wherein $\text{-}(Q\text{—}X^2)$ is a diffusible magenta-dye moiety, and an alkali-permeable layer containing a red-sensitive silver halide having associated therewith a BEND compound of said formula wherein $\text{-}(Q\text{—}X^2)$ is a diffusible cyan-dye moiety.

76. An image-transfer process according to claim 74 wherein said electron-transfer agent is a pyrazolidone compound and said electron donor is a hydrolyzable electron donor.

77. An image-transfer process according to claim 74 wherein said electron donor is a compound of the formula:

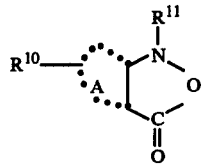

wherein A represents a group containing the atoms necessary to form a 5- to 6-membered aromatic ring with the remainder of said formula; $R^{10}$ represents a hydrogen atom or one or more organic groups containing from 1–30 carbon atoms; and $R^{11}$ is an alkyl group containing from 1–30 carbon atoms or an aryl group containing from 6–30 carbon atoms.

78. An image-transfer process according to claim 74 wherein said electron donor is a hydrolyzable electron donor which has a redox $t_{\frac{1}{2}}$ with said BEND of at least 5 seconds and no more than 30 minutes.

79. An image-transfer process according to claim 74 wherein said BEND compound has the formula:

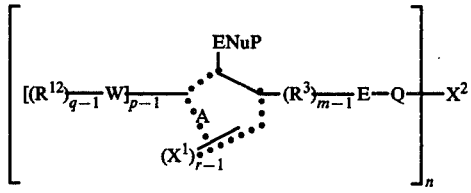

wherein ENuP is a nitro group; A represents a group containing the atoms necessary to form an aromatic ring with the remainder of said formula; W is an electron-withdrawing group; $R^{12}$ is a hydrogen atom, an alkyl group or an aryl group; $R^3$ is a bivalent organic group containing from 1–3 atoms in the bivalent linkage; m and q are positive integers of 1 or 2; p and r are positive integers of 1 or greater, with $[(R^{12})_{q-1}W]$ being a substituent on any portion of the aromatic-ring structure of A; E and Q provide an electrophilic cleavage group where E is an electrophilic center and Q is a group providing a monoatom linkage between E and $X^2$ wherein said monoatom can be an oxygen atom, a sulfur atom, a selenium atom or a nitrogen atom which provides an amino group; n is an integer of 1–3; $X^2$, together with Q, is an image dye-providing material; $X^1$ is a ballasting group; and at least one of $X^1$ and $R^{12}$ is present in said compound and is of a size sufficient to render said compound immobile.

80. An image-transfer process according to claim 74 wherein said electron donor is a hydrolyzable electron donor.

81. An image-transfer process according to claim 74 wherein said BEND compound has the formula:

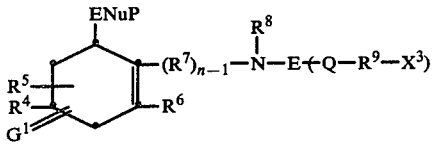

wherein ENuP is an oxo group; E is carbonyl or thiacarbonyl; Q is a group providing a monoatom linkage between E and $R^9$ wherein said monoatom is a nonmetallic atom of Group VA or VIA of the periodic table in its minus 2 or minus 3 valence state; $G^1$ is a dialkylimino group, a sulfonimido group or any of the groups specified for ENuP; $R^7$ is a bivalent alkylene group containing from 1–3 atoms in the bivalent linkage; n is a positive integer of 1 or 2; $R^9$ can be an aromatic group or an alkylene group; $R^8$ can be an alkyl group containing from 1–40 carbon atoms, an aryl group containing from 6–20 carbon atoms, or the substituent $X^1$; $R^6$, $R^4$ and $R^5$ can each be monoatom groups which can be hydrogen atoms, halogen atoms or polyatomic groups which can be alkyl groups, aryl groups, carbonyl groups, sulfamyl groups, sulfonamido groups or the substituent $X^1$, and the substituents for $R^6$ and $R^5$ or $R^4$ and $R^5$ when on adjacent positions on the ring may be taken together to form a 5- or 6-membered ring with the remainder of the molecule with the provision that, when $R^9$ is an alkylene group, $R^6$ and $R^4$ are polyatomic groups, and when $G^1$ is a substituent defined for ENuP, an adjacent $R^6$ or $R^4$ can be the group:

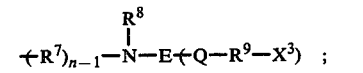

$X^1$ is provided in at least one of the substituent positions and is a ballasting group of sufficient size to render said compound immobile in an alkali-permeable layer of the photographic element, or is an image dye-providing moiety; $X^3$ is a group which, together with Q and $R^9$, can be a ballasting group or an image dye-providing moiety as defined for $X^1$, provided one of $X^1$ and $+Q—R^9—X^3)$ is said ballasting group and one of $X^1$ and $+Q—R^9—X^3)$ is said image dye-providing moiety.

82. An image-transfer process according to claim 81 wherein said electron donor is a hydrolyzable electron donor and said electron-transfer agent is a 3-pyrazolidone compound.

83. An image-transfer film unit comprising:

(a) a photographic element comprising a support having at least one alkali-permeable layer thereon containing a photographic, light-sensitive, silver halide composition which has associated therewith a BEND compound having the formula:

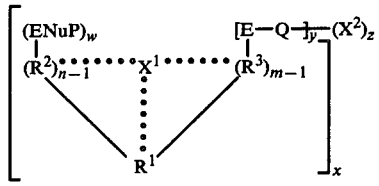

wherein w, x, y, z, n and m are positive integers of 1 or 2; ENuP is an electron-accepting nucleophilic precursor group; $R^1$ is an organic group providing a cyclic group to which ENuP and E are attached optionally through $R^2$ and $R^3$; $R^2$ and $R^3$ are bivalent organic groups containing from 1–3 atoms in the bivalent linkage; E and Q provide an electrophilic cleavage group where E is an electrophilic group and Q is a group providing a mono atom linkage between E and $X^2$ and which can be displaced from E by the nucleophilic group provided by ENuP, wherein said monoatom is a nitrogen atom, an oxygen atom or a sulfur atom; $X^1$ is a substituent on at least one of $R^1$, $R^2$ and $R^3$, and one of $X^1$ or Q—$X^2$ is a ballasting group of sufficient size to render said compound immobile in an alkali-permeable layer of a photographic element, and one of $X^1$ and Q—$X^2$ is an image dye-providing material or a photographic reagent;

(b) an image dye-receiving layer;

(c) a container means containing an alkaline processing composition;

(d) an electron-transfer agent which is a silver halide developer; and (e) a hydrolyzable electron donor associated with said BEND compound.

84. An image-transfer element according to claim 83 wherein said electron-transfer agent is a 3-pyrazolidone compound.

85. An image-transfer element according to claim 83 wherein said electron donor has a redox $t_{\frac{1}{2}}$ of at least 5 seconds and less than 30 minutes with said BEND compound.

86. A film unit according to claim 83 wherein said electron-transfer agent has a redox $t_{\frac{1}{2}}$ which is longer than the redox $t_{\frac{1}{2}}$ of the electron donor with BEND.

87. A film unit according to claim 83 wherein said electron-transfer agent has a redox $t_{\frac{1}{2}}$ which is at least 10 times longer than the redox $t_{\frac{1}{2}}$ with said BEND.

88. A film unit according to claim 83 wherein said electron-transfer agent has a polarographic potential which is more positive than −200 mv, and said electron donor has a polarographic potential which is more negative than −200 mv with reference to a saturated calomel electrode.

89. A film unit according to claim 83 wherein said electron donor has the formula:

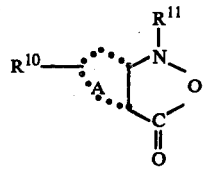

wherein A represents a group containing the atoms necessary to form a 5- to 6-membered aromatic ring with the remainder of said formula; $R^{10}$ represents a hydrogen atom or one or more organic groups containing from 1–30 carbon atoms; and $R^{11}$ is an alkyl group containing from 1–30 carbon atoms or an aryl group containing from 6–30 carbon atoms.

90. A film unit according to claim 89 wherein $R^{10}$ is one or more organic groups containing a total of at least 8 carbon atoms whereby said electron donor is at least semi-immobile in the alkali-permeable layers of the film unit.

91. A film unit according to claim 89 wherein A represents a group containing the atoms necessary to form a carbocyclic aromatic ring with the remainder of said formula, $R^{11}$ is a methyl group and $R^{10}$ represents one or more groups containing from 8–30 carbon atoms.

92. A film unit according to claim 89 wherein A represents a group containing the atoms necessary to form a carbocyclic aromatic ring with the remainder of said formula and $R^{10}$ represents one or more N-substituted carbamoyl groups containing from 8–30 carbon atoms.

93. A film unit according to claim 89 wherein said electron-transfer agent is 4-methyl-4-hydroxymethyl-1-phenyl-3-pyrazolidone.

94. A film unit according to claim 83 wherein said photographic element comprises an alkali-permeable layer containing a blue-sensitive silver halide having associated therewith a BEND compound of said formula wherein said $\text{-}(Q\text{—}X^2)$ is a diffusible yellow-dye moiety, an alkali-permeable layer containing a green-sensitive silver halide having associated therewith a BEND compound of said formula wherein $\text{-}(Q\text{—}X^2)$ is a diffusible magenta-dye moiety, and an alkali-permeable layer containing a red-sensitive silver halide having associated therewith a BEND compound of said formula wherein $\text{-}(Q\text{—}X^2)$ is a diffusible cyan-dye moiety, and each said silver halide emulsion also has associated therewith an electron donor having the formula:

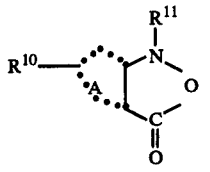

wherein A represents a group containing the atoms necessary to form a 5- to 7-membered aromatic ring with the remainder of said formula; $R^{10}$ represents a hydrogen atom or one or more organic groups containing from 1–30 carbon atoms; and $R^{11}$ is an alkyl group containing from 1–30 carbon atoms or an aryl group containing from 6–30 carbon atoms.

95. A film unit according to claim 94 wherein said electron-transfer agent is a 3-pyrazolidone compound.

96. A film unit according to claim 83 wherein $\text{-}(Q\text{—}X^2)$ is an image dye-providing material and x is 1.

97. A photographic element comprising at least one alkali-permeable layer containing a photographic light-sensitive silver halide having associated therewith a BEND compound having the formula:

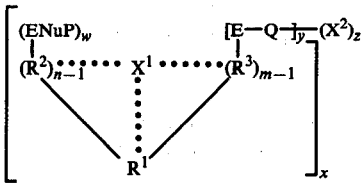

wherein w, x, y, z, n and m are positive integers of 1 or 2; ENuP is an electron-accepting nucleophilic precursor group; $R^1$ is an organic group providing a cyclic group to which ENuP and E are attached optionally through $R^2$ and $R^3$; $R^2$ and $R^3$ are bivalent organic groups containing from 1–3 atoms in the bivalent linkage; E and Q provide an electrophilic cleavage group wherein E is an electrophilic group and Q is a group providing a monoatom linkage between E and $X^2$ and which can be displaced from E by the nucleophilic group provided by ENuP, wherein said monoatom is a nitrogen atom, an oxygen atom, a selenium atom or a sulfur atom; $X^1$ is a substituent on at least one of $R^1$, $R^2$ and $R^3$, and one of $X^1$ or $Q\text{—}X^2$ is a ballasting group of sufficient size to render said compound immobile in an alkali-permeable layer of a photographic element, and one of $X^1$ and $Q\text{—}X^2$ is a photographic reagent.

98. A photographic element according to claim 97 wherein $Q\text{—}X^2$ is a development inhibitor and $X^1$ is said ballasting group, and x is 1.

99. A photographic element according to claim 97 wherein $Q\text{—}X^2$ is a triazole or tetrazole moiety and Q is a sulfur atom or an amino group.

100. A photographic element according to claim 97 wherein said BEND compound has associated therewith an electron donor compound.

101. A photographic element comprising a support having thereon at least one layer containing a photographic, light-sensitive silver halide having associated therewith a BEND compound having the formula:

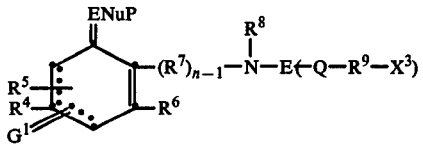

wherein ENuP is an electron-accepting nucleophilic precursor for an hydroxy nucleophilic group; E is carbonyl or thiocarbonyl; Q is a group providing a monoatom linkage between E and $R^9$ wherein said monoatom is a nonmetallic atom of Group VA or VIA of the periodic table in its minus 2 or minus 3 valence state; $G^1$ is an imido group or any of the groups specified for ENuP; $R^7$ is a bivalent alkylene group containing from 1–3 atoms in the bivalent linkage; n is a positive integer of 1 or 2; $R^9$ can be an aromatic group or an alkylene group; $R^8$ can be an alkyl group containing from 1 to 40 carbon atoms, an aryl group containing from 6–20 carbon atoms, or the substituent $X^1$; $R^6$, $R^4$ and $R^5$ can each be monoatom groups which can be hydrogen atoms, halogen atoms or polyatomic groups which can be alkyl groups, aryl groups, carbonyl groups, sulfamyl groups, sulfonamido groups or the substituent $X^1$, and the substituents for $R^6$ and $R^5$ or $R^4$ and $R^5$ when on adjacent positions on the ring may be taken together to form a 5- or 6-membered ring with the remainder of the molecule with the provision that, when $R^9$ is an alkylene group, $R^6$ and $R^4$ are polyatomic groups, and when $G^1$ is a substituent defined for ENuP, an adjacent $R^6$ or $R^4$ can be the group:

$$\left(R^7\right)_{n-1}-\overset{\overset{\displaystyle R^8}{|}}{N}-E\left(Q-R^9-X^3\right) \quad ;$$

$X^1$ is provided in at least one of the substituent positions and is a ballasting group of sufficient size to render said compound immobile in an alkali-permeable layer of the photographic element, or is a photographic reagent; $X^3$ is a group which, together with Q and $R^9$, can be a ballasting group or photographic reagent as defined for $X^1$, provided one of $X^1$ and $\left(Q-R^9-X^3\right)$ is said ballasting group and one of $X^1$ and $\left(Q-R^9-X^3\right)$ is said photographic reagent.

102. A photographic element according to claim 101 wherein $\left(Q-R^9-X^3\right)$ of said BEND compound is a development inhibitor.

103. A photographic element according to claim 101 wherein said BEND compound contains Q as a sulfur atom and $\left(Q-R^9-X^3\right)$ is a 5-mercapto-1-phenyltetrazole moiety.

104. A photographic element according to claim 101 wherein said BEND is a compound of the formula:

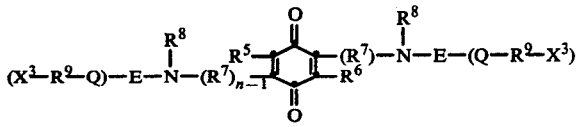

wherein E is a carbonyl; Q is a group which provides a mono-atom linkage between E and $R^9$ wherein said monoatom is a sulfur atom or a nitrogen atom; $R^7$ is a bivalent alkylene group containing from 1–3 atoms in the bivalent linkage; n is a positive integer of 1 or 2; $R^9$ is an aromatic group; $R^8$ is an alkyl group containing from 1–40 carbon atoms, an aryl group containing from 6–20 carbon atoms, or the substituent $X^1$; $R^5$ and $R^6$ can each be monoatom groups which can be hydrogen atoms, halogen atoms or polyatomic groups which can be alkyl groups, aryl groups, carbonyl groups, sulfamyl groups, sulfonamido groups or the substituent $X^1$; $X^1$ is provided in at least one of the substituent positions and is a ballasting group of sufficient size to render said compound immobile in an alkaline-permeable layer of a photographic element; and $X^3$ is a group which, together with Q and $R^9$, is an antifoggant or a development inhibitor.

105. A photographic element according to claim 101 wherein $\left(Q-R^9-X^3\right)$ is a tetrazole moiety.

106. A photographic element according to claim 101 wherein $\left(Q-R^9-X^3\right)$ is a triazole moiety.

* * * * *

UNITED STATES PATENT AND TRADEMARK OFFICE

CERTIFICATE OF CORRECTION

PATENT NO. :4,139,379

DATED :February 13, 1979

INVENTOR(S) :Chasman et al

It is certified that error appears in the above-identified patent and that said Letters Patent are hereby corrected as shown below:

Title page, column 2, line 17, "Stereopopulaton" should read --Stereopopulation--. Column 5, line 32, after "to", --a-- should be inserted. Column 8, line 8, "oxoalkylene" should read --oxaalkylene,--; line 35, "Q-$M^2$" should read --Q-$X^2$--. Column 11, line 55, the formula reading:

$$(R^7)_{N-1}-\overset{R^8}{\overset{|}{N}}-E(Q-R^9-X^3) \quad \text{should read} \quad (R^7)_{n-1}-\overset{R^8}{\overset{|}{N}}-E(Q-R^9-X^3) \quad .$$

Column 12, line 19, "Thritle" should read --Thirtle--. Column 14, line 31, "halflife" should read --half-life--. Column 19, 2nd formula (ED-9), that part of the formula reading:

$$Q \quad \text{should read} \quad O \quad .$$

Column 22, line 67, "protp-hydroquinone" should read --protohydroquinone. Column 27, line 5, "affect" should read --effect--. Column 35, line 65, "the" should read --The--. Column 43, line 66,

UNITED STATES PATENT AND TRADEMARK OFFICE

CERTIFICATE OF CORRECTION

PATENT NO. :4,139,379

DATED :February 13, 1979

INVENTOR(S) :Chasman et al

It is certified that error appears in the above-identified patent and that said Letters Patent are hereby corrected as shown below:

"dired" should read --dried--. Column 49, line 20, "2" should read --3--. Column 50, line 21, "P" should read --p--. Column 51, line 7, "imido" should read --imino--; line 19, "sbustituent" should read --substituent--. Column 53, line 46, "gorup" should read --group--. Column 55, line 58, "49" should read --47--; line 60, "49" (second occurrence) should read --47--; line 62, "49" should read --47--. Column 57, line 68, after "group", --;-- should be inserted.

line 50, "sulfonamido" should read --sulfonimido--. Column 61, line 1, "imido" should read --imino--. Column 63, line 32, "dialkylimino" should read --alkylimino--. Column 66, line 37, "97" should read --98--; line 40, "97" should read --98--; line 61, "imido" should read --imino--. Column 68, line 28, "101" should read --104--; line 30, "101" should read --104--.

Signed and Sealed this

*Thirty-first* Day of *July 1979*

[SEAL]

*Attest:*

*Attesting Officer*

LUTRELLE F. PARKER

*Acting Commissioner of Patents and Trademarks*